US006302070B1

(12) United States Patent
Tsukui et al.

(10) Patent No.: US 6,302,070 B1
(45) Date of Patent: Oct. 16, 2001

(54) VALVE SYSTEM FOR ENGINE

(75) Inventors: Takaaki Tsukui; Takashi Ichimura; Yoshihiko Kumagai, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/480,650

(22) Filed: Jan. 11, 2000

(30) Foreign Application Priority Data

Jan. 11, 1999 (JP) ..... 11-004630

(51) Int. Cl.[7] ..... F01L 13/00; F01L 1/14
(52) U.S. Cl. ..... 123/90.16; 123/198 F
(58) Field of Search ..... 123/90.15, 90.16, 123/90.48, 198 F; 74/569

(56) References Cited

U.S. PATENT DOCUMENTS 4,770,137 * 9/1988 Okabe et al. ..... 123/198 F
5,361,734 * 11/1994 Shirai ..... 123/90.16
5,558,052 * 9/1996 Schwarzenthal et al. ..... 123/90.16
5,603,293 * 2/1997 Schwarzenthal et al. ..... 123/90.16

FOREIGN PATENT DOCUMENTS

Y2-3 7526 2/1991 (JP) .

* cited by examiner

*Primary Examiner*—Weilun Lo
(74) *Attorney, Agent, or Firm*—Birch, Stewart, Kolasch & Birch, LLP

(57) ABSTRACT

A valve system for an engine including a valve resting mechanism provided between an engine valve and a valve lifter supported by a cylinder head. The valve resting mechanism can place the engine valve into a resting state. The valve resting mechanism has a pin holder which includes a sliding hole having an axis perpendicular to the axis of a valve lifter, and an insertion hole for allowing a valve stem to pass therethrough. The pin holder is slidably fitted in the valve lifter. A slide pin is slidably fitted in the sliding hole, with a hydraulic force and a spring force applied to both ends of the slide pin. A containing hole is coaxially connectable to the insertion hole, and a rotation stopping means for stopping axial rotation of the slide pin is provided between the pin holder and the slide pin.

5 Claims, 15 Drawing Sheets

VALVE SYSTEM FOR ENGINE

BACKGROUND OF THE INVENTION

1. Field of the Invention

The present invention relates to a valve system for an engine, including a valve resting mechanism provided between an engine valve and a valve lifter supported by a cylinder head so as to be slidably driven by a valve system cam. The valve resting mechanism is capable of switching an acting state and a non-acting state of a pressing force applied from the valve lifter to the engine valve in the valve opening direction and turning, in the non-acting state of the pressing force, the engine valve into the resting state irrespective of the sliding motion of the valve lifter.

2. Related Art

A valve system of this type has been known, for example, from Japanese Utility Model Publication No. Hei 3-7526. In a valve resting mechanism of the valve system disclosed in this document, a slide pin having a containing hole capable of containing the leading end of a valve stem of an engine valve is directly fitted in a valve lifter supported in a cylinder head so as to be slidably driven by a valve system cam. The rotation of the slide pin around its axis is prevented by fitting the leading end of the valve stem in a groove formed in a pin holder.

The above valve resting mechanism, however, has a disadvantage: The rotation stop of the slide pin is achieved in a state in which the valve resting mechanism is assembled in the valve stem of the engine valve. In other words, the rotation stop of the slide pin with respect to the valve lifter is not achieved in the step of assembling the valve resting mechanism. As a result, it is difficult to align the groove of the pin holder with the leading end of the valve stem upon assembly of the valve lifter in the cylinder head. This complicates the step of assembling the valve resting mechanism.

In view of the foregoing, an object of the present invention is to provide a valve system for an engine valve which facilitates the work of assembling a valve resting mechanism.

SUMMARY OF THE INVENTION

To achieve the above object, there is provided a valve system for an engine including an engine valve including a valve body capable of opening/closing a valve port provided in a cylinder head so as to be opened to a combustion chamber, and a valve stem whose base end is integrated with the valve body, the engine valve being openably/closably supported in the cylinder head so as to be spring-biased in the direction of closing the valve port. A valve lifter is supported in the cylinder head so as to be slidable in the same axial direction as the axis of the valve stem. A valve resting mechanism is provided between the valve lifter and the engine valve, the valve resting mechanism being capable of switching an acting state and a non-acting state of a pressing force applied from the valve lifter to the engine valve in the valve opening direction and turning, in the non-acting state of the pressing force, the engine valve into the resting state irrespective of the sliding motion of the valve lifter.

In this valve system, the valve resting mechanism includes a pin holder slidably fitted in the valve lifter formed into a bottomed cylinder shape with its end on the valve system cam closed. The pin holder has a sliding hole having an axis perpendicular to the axis of the valve lifter, and an insertion hole opened in the inner surface of the sliding hole so as to allow the valve stem to be movably inserted therethrough in the axial direction. A slide pin is slidably fitted in the sliding hole with its one end facing to an hydraulic chamber, the slide pin having a containing hole coaxially connectable to the insertion hole. A return spring is included for biasing the slide pin in the direction of reducing the volume of the hydraulic chamber. A rotation stopping means is provided between the pin holder and the slide pin for stopping the rotation of the slide pin around its axis. The slide pin is fitted in the sliding hole so as to be slidable between a position wherein the containing hole is coaxially aligned to the insertion hole for allowing the leading end of the valve stem to be contained in the containing hole, and a position wherein the leading end of the valve stem is brought into contact with the outer side surface of the slide pin.

With this configuration, when the slide pin is moved to the position wherein the containing hole is coaxially aligned to the insertion hole of the pin holder, the pin holder and the slide pin are moved, together with the valve lift, to the engine valve side due to the sliding motion of the valve lifter by a pressing force applied from the valve system cam. However, only the leading end of the valve stem inserted in the insertion hole is contained in the containing hole and the pressing force in the valve opening direction is not applied from the valve lifter and the pin holder to the engine valve. The result is that the engine valve remains rested.

When the slide pin is moved to the position wherein the outer side surface is brought into contact with the leading end of the valve stem, the pressing force in the valve opening direction is applied to the engine valve along with the movement of the pin holder and the slide pin toward the engine valve due to the sliding motion of the valve lifter by the pressing force applied from the valve system cam. The result is that the engine valve is operated to be opened/closed in accordance with the rotation of the valve system cam. Also, since the rotation of the slide pin around its axis in the pin holder is prevented by the rotation stopping means, the valve resting mechanism can be easily assembled to the valve stem by mounting the valve lifter to the cylinder head in a state that the pin holder in which the slide pin has been fitted is fitted in the valve lifter.

The rotation stopping means can be a stopper pin mounted in the pin holder so as to pass through the slide pin, while permitting the movement of the slide pin in the axial direction. With this configuration, the rotation stopping means can be simplified.

The pin holder can have an extension hole capable of containing the leading end of the valve stem, the extension hole being coaxial with the insertion hole with the sliding hole put between the insertion hole and the extension hole. A shim for blocking an end portion of the extension hole on the closed end side of the valve lifter can be mounted on the pin holder so as to be allowed to be brought into contact with the closed end of the valve lifter.

Because the leading end of the valve stem is contained not only in the containing hole but also in the extension hole in the valve resting state, it is possible to reduce the length of the containing hole, that is, the diameter of the slide pin, and hence to miniaturize the pin holder and further miniaturize the valve resting mechanism as a whole. Further, it is required to block the end portion of the extension hole on the closed end side of the valve lifter for applying a pressing force from the valve lifter to the pin holder, and according to this invention, the end portion of the extension hole is blocked with the shim brought into contact with the closed end of the valve lifter. Accordingly, it is possible to simplify the structure of the pin holder, and to suitably adjust a gap at the valve head of the engine valve by changing the thickness of the shim.

A containing cylinder portion coaxial with the axis of the extension hole can be integrally provided on the pin holder at a position facing to the closed end of the valve lifter, and the shim formed into a disk shape is partially fitted in the containing cylinder portion. With this configuration, it is possible to simply mount a relatively small shim on the pin holder.

A projecting portion to be in contact with the shim is integrally provided on the inner surface of the closed end of the valve lifter. With this configuration, the sliding motion of the valve lifter with respect to the cylinder head can be reliably performed along the axis of the valve stem so that the pressing force is applied from the valve lifter to the pin holder on the extension of the axis of the valve stem of the engine valve. As a result, the sliding motion of the valve lifter can be smoothened.

A coil spring for biasing the pin holder toward the closed end of the valve lifter can be provided between the pin holder and the cylinder head so as to surround the valve stem at a position wherein the outer periphery of the coil spring is not in contact with the inner surface of the valve lifter; and positioning portions for positioning an end portion of the coil spring in the direction perpendicular to the axis of the valve stem are provided on the pin holder. With this configuration, it is possible to reliably apply the spring force of the coil spring along the axis of the valve stem, and to prevent the occurrence of a frictional loss due to the slide-contact of the outer periphery of the coil spring with the valve lifter Positioning portions are projections integrally provided on the pin holder, and the projecting amount of each of the projections is less than the diameter of the coil spring. The positioning portions can be grooves provided in the pin holder, the depth of each of the grooves being less than the diameter of the coil spring. Even if the coil spring is contracted, it is not in slide-contact with the pin holder. As a result, it is possible to prevent the occurrence of the frictional loss due to the slide-contact of the coil spring with the pin holder.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
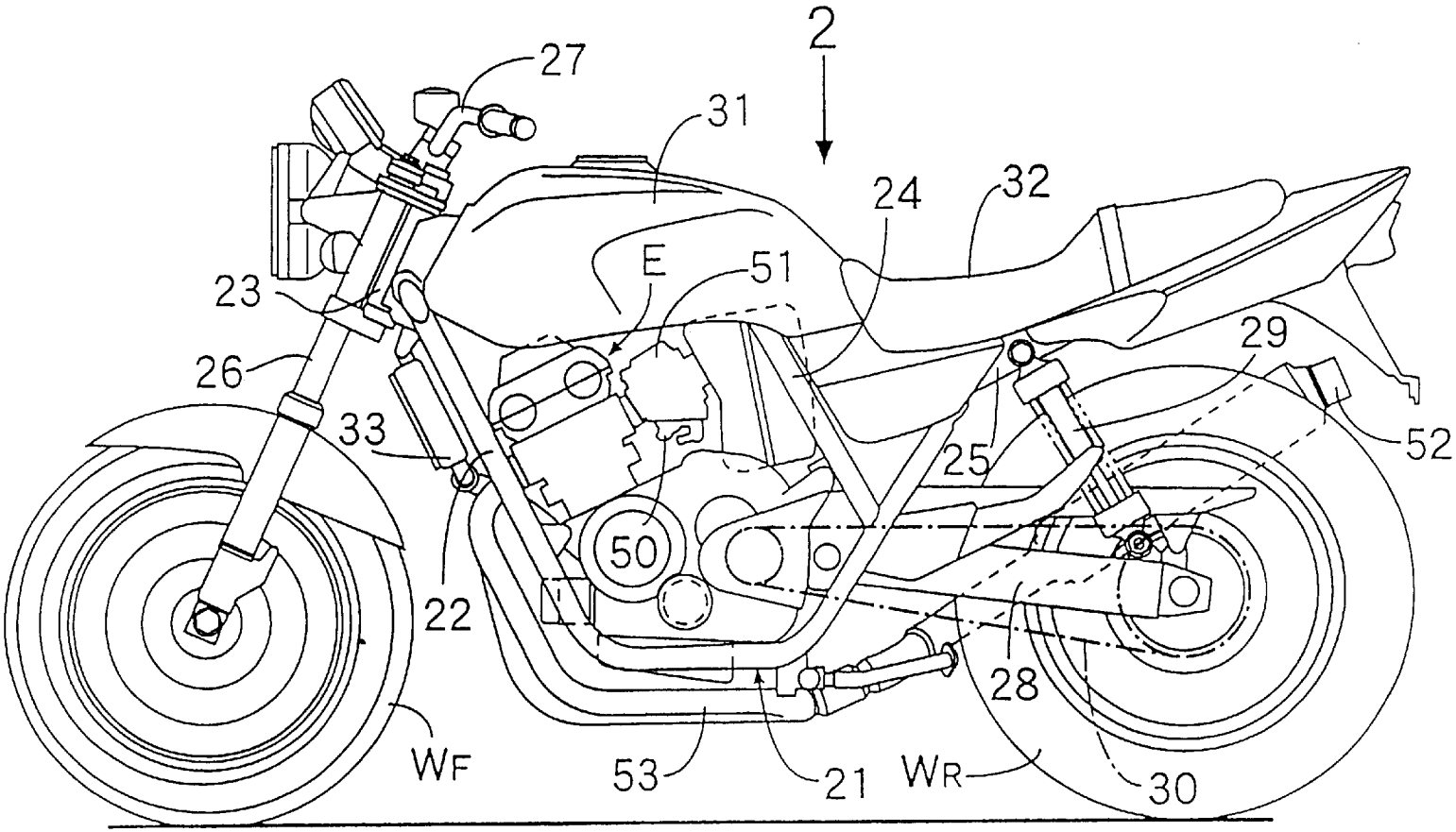
FIG. 1 is a side view of a motorcycle according to a first embodiment of the invention.
Figure 2:
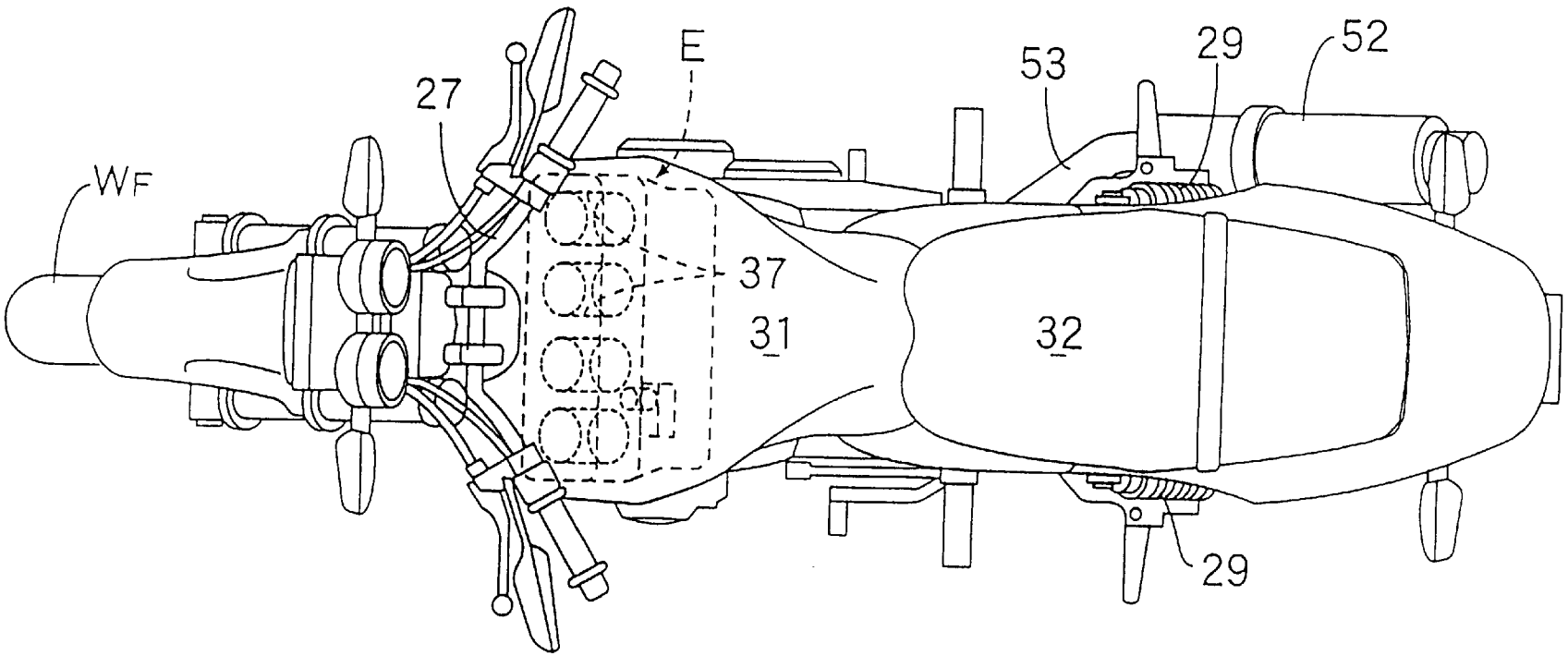
FIG. 2 is a plan view seen from arrow 2 of FIG. 1.

Referring first to FIGS. 1 and 2, a body frame 21 of a motorcycle according to the present invention includes a pair of right and left main frames 22 each being formed into an approximately U-shape opened upwardly. A head pipe 23 is provided at front ends of the main frames 22, and a connection frame 24, formed into an approximately U-shape opens downwardly, for connecting rear portions of the main frames 22 to each other. A seat stay 25 is connected to rear ends of the main frames 22 and extends rearwardly, obliquely upwardly therefrom. A front fork 26 for supporting a front wheel WF is steerably supported by the head pipe 23, and a steering handle 27 is connected to the front fork 26. A rear fork 28 for supporting a rear wheel WR is vertically pivotably supported by a rear portion of one of the main frames 22, and a pair of cushion units 29 are provided between the seat stay 25 and the rear wheel WR.

An engine E is supported by the main frames 22 and the connecting frame 24, and power is transmitted to the rear wheel WR via a transmission assembled in the engine E and a chain transmission 30.

A fuel tank 31 is mounted on the right and left main frames 22 and the connection frame 24 so as to be positioned over the engine E. A tandem seat 32 is mounted on the seat stay 25, and a radiator 33 is disposed in front of the engine E.

Figure 3:
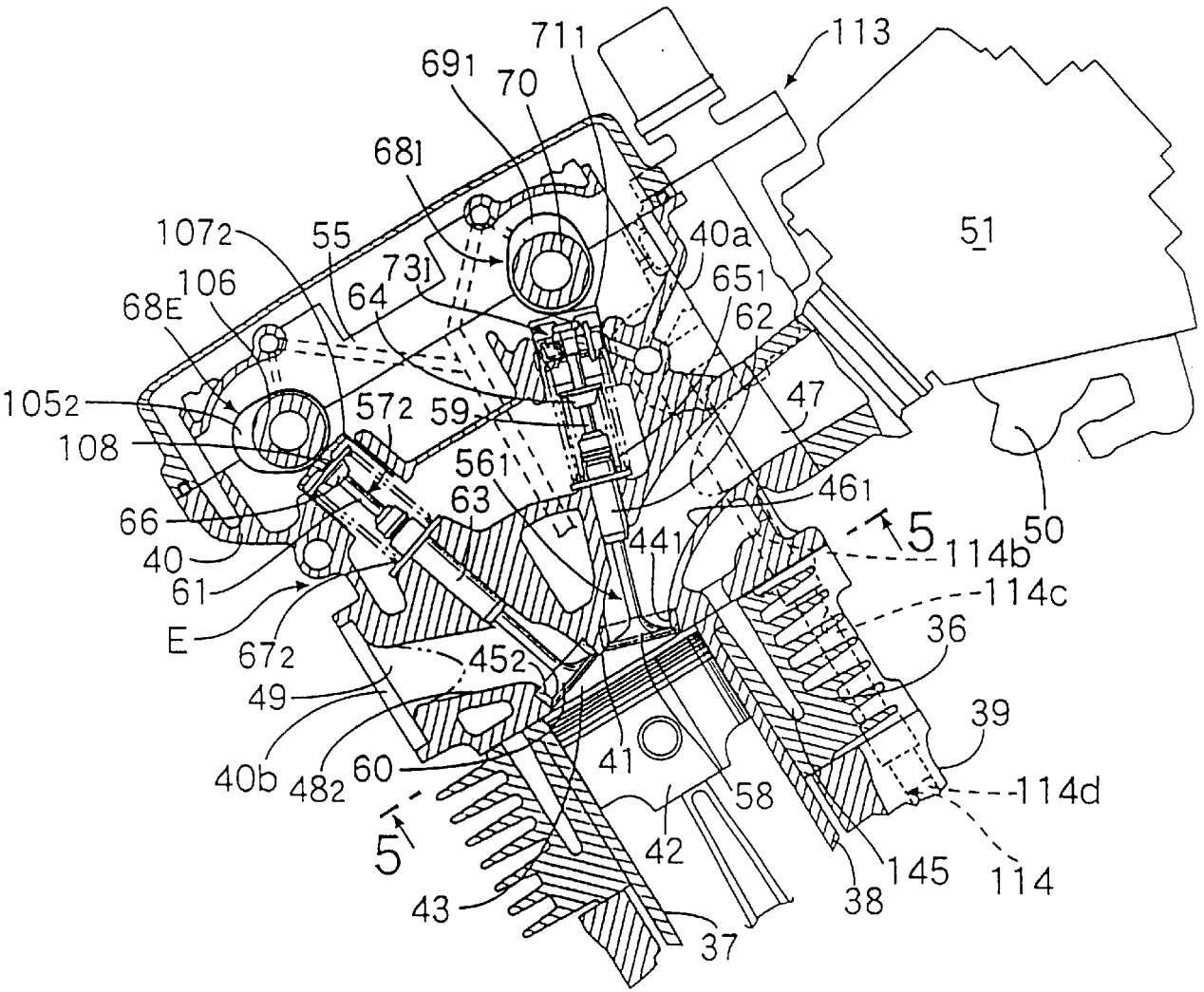
FIG. 3 is partial vertical sectional view, taken on line 3—3 of FIG. 5.
Figure 4:
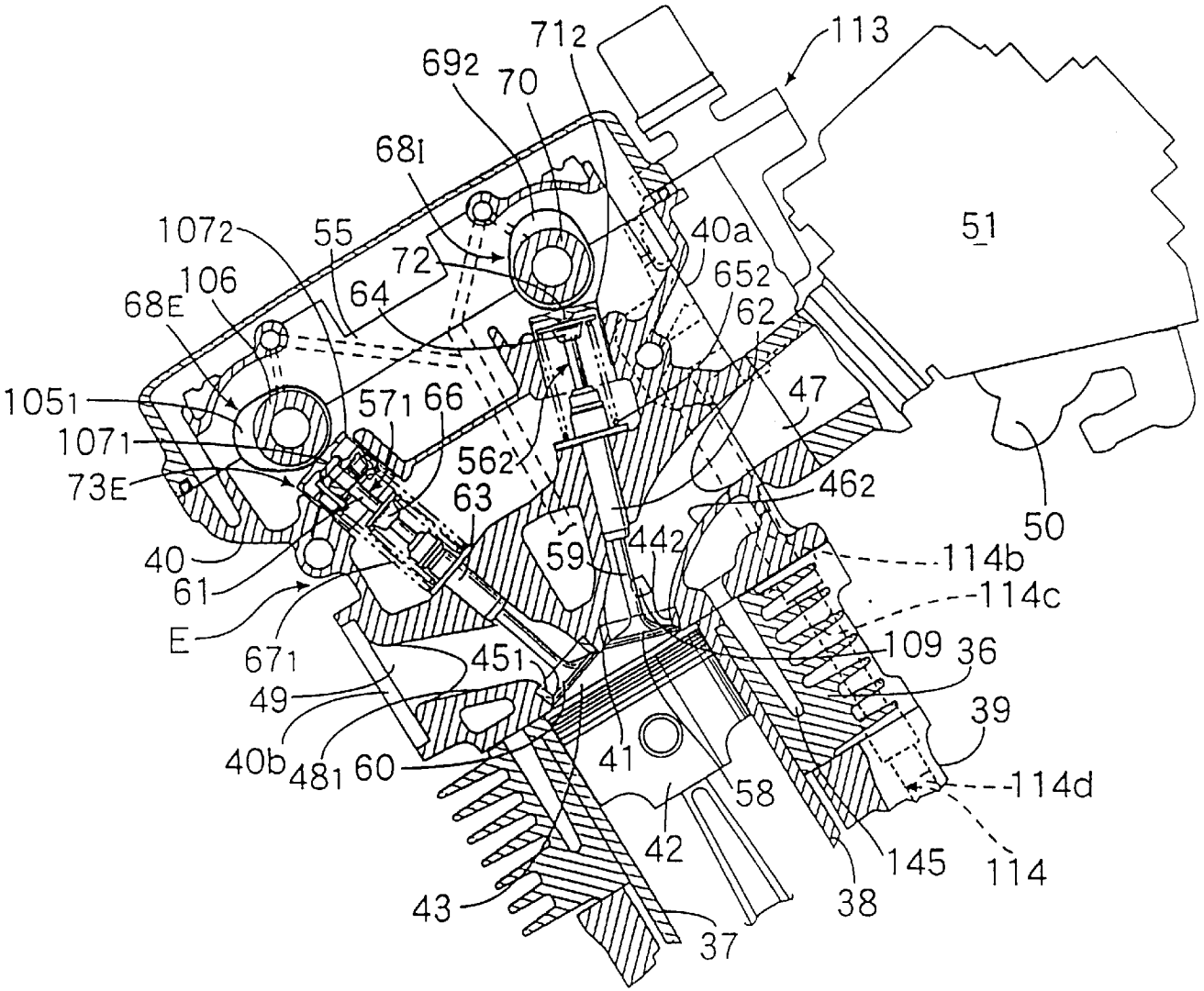
FIG. 4 is a transverse sectional view, taken on line 4–4 of FIG. 5.

Referring to FIGS. 3 and 4, the engine E is a multi-cylinder (for example, four-cylinder)/four cycle engine. A plurality (for example, four) of cylinder bores 37 are formed in a cylinder block 36 of the engine E so as to be arranged along the width direction of the body frame 21. The cylinder bores 37 are tilted upwardly and forwardly. To be more specific, cylinder liners 38 for forming the cylinder bores 37 are fixed in the cylinder block 36 so as to be spaced from each other at intervals along the width direction of the body frame 21. Each cylinder liner 38 is partially inserted in an upper crank case 39 connected to a lower portion of the cylinder block 36.

A cylinder block 40 is connected to an upper portion of the cylinder block 36. Recesses 41 individually corresponding to the cylinder bores 37 are provided in a connection plane of the cylinder head 40 to the cylinder block 36. Combustion chambers 43 including the recesses 41 are formed between the cylinder head 40 and top portions of pistons 42 slidably fitted in the cylinder bores 37.

Figure 5:
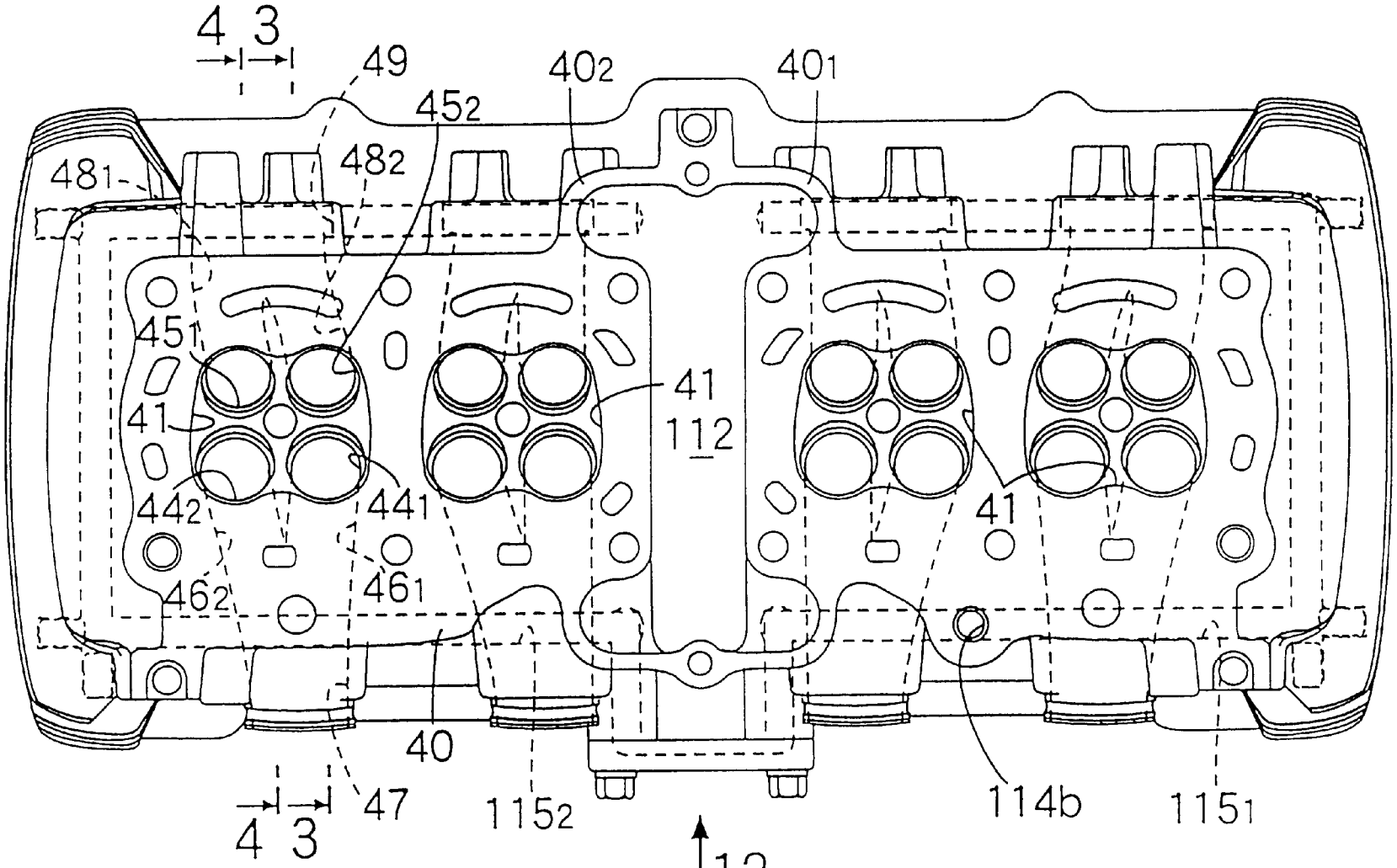
FIG. 5 is a bottom view, seen from arrows 5—5 of FIG. 3, of a cylinder head.

Referring to FIG. 5, a plurality (for example, a pair) of first and second intake valve ports $\mathbf{44}_1$ and $\mathbf{44}_2$ open to the combustion chamber 43, and a plurality of (for example, a pair) of first and second exhaust valve ports $\mathbf{45}_1$, and $\mathbf{45}_2$ open to the combustion chamber 43. The intake and exhaust ports are provided in the cylinder head 40. The first intake valve port $\mathbf{44}_1$, and the first exhaust valve port $\mathbf{45}_1$, are substantially symmetrically disposed with respect to the center of the combustion chamber 43, and the second intake valve port $\mathbf{44}_2$ and the second exhaust valve port $\mathbf{45}_2$ are substantially symmetrically disposed with respect to the center of the combustion chamber 43.

Figure 6:
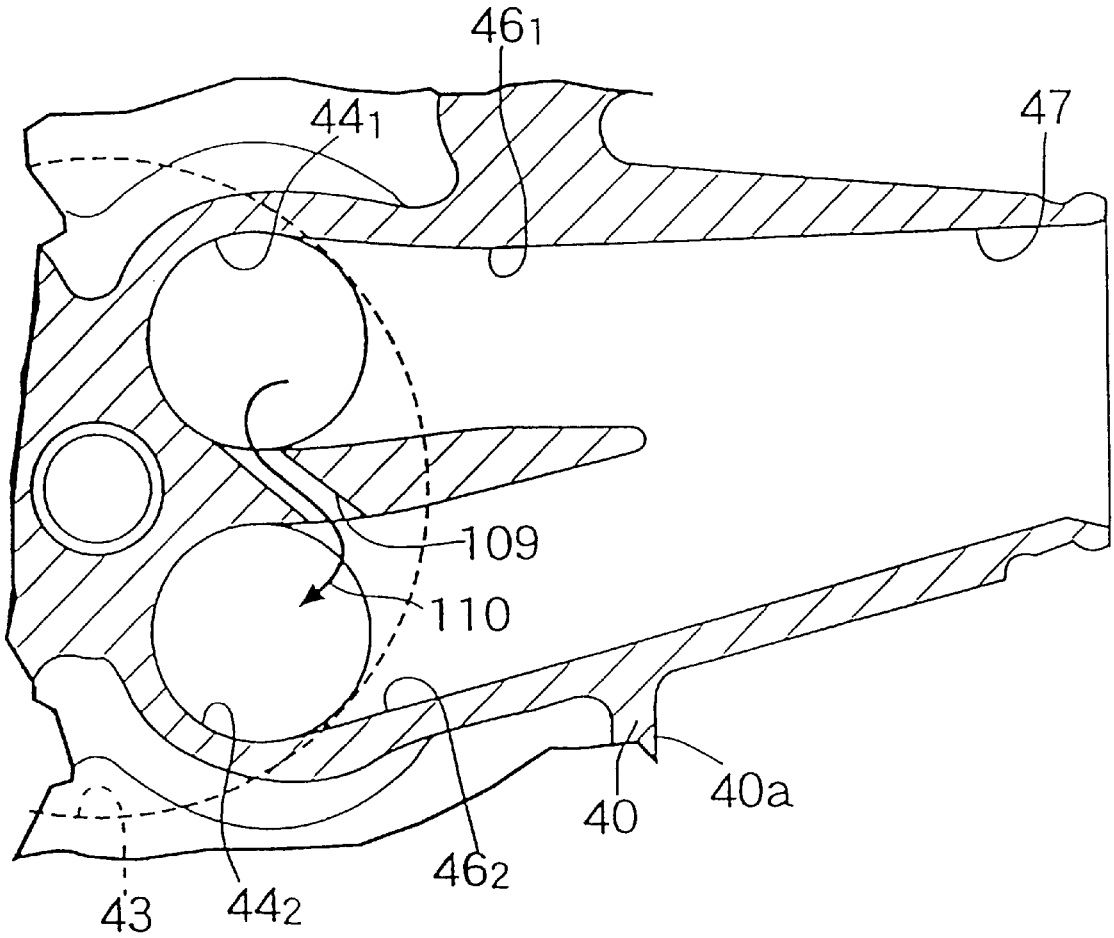
FIG. 6 is a partial transverse sectional view of the cylinder head near an intake port.

Referring to FIG. 6, a first intake passage $\mathbf{46}_1$, connected to the first intake valve port $\mathbf{44}_1$, a second intake passage $\mathbf{46}_2$ connected to the second intake valve port $\mathbf{44}_2$, and an intake port 47 commonly connected to the first and second intake passages $\mathbf{46}_1$, and $\mathbf{46}_2$ and opened to one side surface 40*a* of the cylinder head 40 are provided in the cylinder head 40. The one side surface 40*a* of cylinder head 40, to which each intake port 47 opens, is disposed on the back of the motorcycle.

A first exhaust passage $\mathbf{48}_1$ connected to the first exhaust valve port $\mathbf{45}_1$, a second exhaust passage $\mathbf{48}_2$ connected to the second exhaust valve port $\mathbf{45}_2$, and an intake port 49 commonly connected to the first and second exhaust passages $\mathbf{48}_1$, and $\mathbf{48}_2$ are opened to the other side surface 40*b* of the cylinder head 40. The exhaust passages and the intake port are provided in the cylinder head 40 for each combustion chamber 43. The other side surface 40*b* of the cylinder head 40 to which each exhaust port 49 is opened is disposed on the front side of the motorcycle.

An intake system 51 including a carburetor 50 common to the intake ports 47 is connected to the intake ports 47. An exhaust system 53 including an exhaust muffler 52 is connected to the exhaust ports 49. The exhaust muffler 52 is disposed on the right side of and forward of the rear wheel WR.

Referring to FIGS. 3 and 4, the communication and cutoff between the first intake valve port $\mathbf{44}_1$ and the first intake passage $\mathbf{46}_1$ is switched by a first intake valve $\mathbf{56}_1$, as an engine valve. The communication and cutoff between the second intake valve port $\mathbf{44}_2$ and the second intake passage $\mathbf{46}_2$ is switched by a second intake valve $\mathbf{56}_2$, as an engine valve. Meanwhile, the communication and cutoff between the first exhaust valve port $\mathbf{45}_1$ and the first exhaust passage $\mathbf{48}_1$ is switched by a first exhaust valve $\mathbf{57}_1$, as an engine valve. The communication and cutoff between the second exhaust valve port $\mathbf{45}_2$ and the second exhaust passage $\mathbf{48}_2$ is switched by a second exhaust valve $\mathbf{57}_2$, as an engine valve.

Each of the first and second intake valves $\mathbf{56}_1$ and $\mathbf{56}_2$ includes a valve body 58 capable of closing the associated one of the intake valve ports $\mathbf{44}_1$ and $\mathbf{44}_2$, and a valve stem 59 having the base end integrally connected to the valve body 58. Each of the first and second exhaust valves $\mathbf{57}_1$ and $\mathbf{57}_2$ includes a valve body 60 capable of closing the associated one of the exhaust valve ports $\mathbf{45}_1$ and $\mathbf{45}_2$, and a valve stem 61 having the base end integrally connected to the valve body 60.

The valve stem 59 of each of the first and second intake valves $\mathbf{56}_1$ and $\mathbf{56}_2$ is slidably fitted in a guide cylinder 62 provided in the cylinder head 40. The valve stem 61 of each of the first and second exhaust valves $\mathbf{57}_1$ and $\mathbf{57}_2$ is slidably fitted in a guide cylinder 63 provided in the cylinder head 40.

A retainer 64 is fixed via split cotters (not shown) to an intermediate point of a portion, projecting upwardly from the guide cylinder 62, of the valve stem 59 of the first intake valve $\mathbf{56}_1$. A coil valve spring $\mathbf{65}_1$ is provided between the retainer 64 and the cylinder head 40, whereby the first intake valve $\mathbf{56}_1$ is biased in the direction of closing the first intake port $\mathbf{44}_1$ by the valve spring $\mathbf{65}_1$.

A retainer 64 is fixed via split cotters (not shown) to the leading end of a portion, projecting upwardly from the guide cylinder 62, of the valve stem 59 of the second intake valve $\mathbf{56}_2$. A coil valve spring $\mathbf{65}_2$ is provided between the retainer 64 and the cylinder head 40, whereby the second intake valve $\mathbf{56}_2$ is biased in the direction of closing the second intake port $\mathbf{44}_2$ by the valve spring $\mathbf{65}_2$.

A retainer 66 is fixed via split cotters (not shown) to an intermediate point of a portion, projecting upwardly from the guide cylinder 63, of the valve stem 61 of the first exhaust valve $\mathbf{57}_1$. A coil valve spring $\mathbf{67}_1$ is provided between the retainer 66 and the cylinder head 40, whereby the first exhaust valve $\mathbf{57}_1$ is biased in the direction of closing the first exhaust port $\mathbf{45}_1$ by the valve spring $\mathbf{67}_1$.

A retainer 66 is fixed via split cotters (not shown) to the leading end of a portion, projecting upwardly from the guide cylinder 63, of the valve stem 61 of the second exhaust valve $\mathbf{57}_2$. A coil valve spring $\mathbf{67}_1$ is provided between the retainer 66 and the cylinder head 40, whereby the second exhaust valve $\mathbf{57}_2$ is biased in the direction of closing the second exhaust port $\mathbf{45}_2$ by the valve spring $\mathbf{67}_2$.

An intake side valve system 68 for driving the first and second intake valves $\mathbf{56}_1$ and $\mathbf{56}_2$ of the combustion chambers 43 includes a cam shaft 70, bottomed cylindrical valve lifters $\mathbf{71}_1$, and bottomed cylindrical valve lifters $\mathbf{71}_2$. The cam shaft 70 has first intake side valve system cams $\mathbf{69}_1$ corresponding to the first intake valves $\mathbf{56}_1$ and the second intake side valve system cams $\mathbf{69}_2$ corresponding to the second intake valves $\mathbf{56}_2$. The valve lifters $\mathbf{71}_1$ are supported by the cylinder head 40 so as to be slidably driven by the first intake side valve system cams $\mathbf{69}_1$. The valve lifters $\mathbf{71}_2$ are supported by the cylinder head 40 so as to be slidably driven by the second intake side valve system cams $\mathbf{69}_2$.

The cam shaft 70 has an axis perpendicular to the extensions of the axes of the valve stems 59 of the first and second intake valves $\mathbf{56}_1$ and $\mathbf{56}_2$, and is rotatably supported between the cylinder head 40 and a holder 55 connected to the cylinder head 40 The valve lifters $\mathbf{71}_1$ are slidably fitted in the cylinder head 40 so as to be slidably movable in the same axial direction as the axes of the valve stems 59 of the first intake valves $\mathbf{56}_1$. The outer surface of the closed end of each valve lifter $\mathbf{71}_1$ is in slide-contact with the associated one of the first intake side valve system cams $\mathbf{69}_1$. The valve lifters $\mathbf{71}_2$ are slidably fitted in the cylinder head 40 so as to be slidably movable in the same axial direction as the axes of the valve stems 59 of the second intake valves $\mathbf{56}_2$. The outer surface of the closed end of each valve lifter $\mathbf{71}_2$ is in slide-contact with the associated one of the second intake side valve system cams $\mathbf{69}_2$.

The leading end of the valve stem 59 of the second intake valve $\mathbf{56}_2$ is in contact with the inner surface of the closed end of the valve lifter $\mathbf{71}_2$ via a shim 72. The second intake valve $\mathbf{56}_2$ is, during operation of the engine E, usually operated to be opened/closed by the second intake side valve system cam $\mathbf{69}_2$.

A valve resting mechanism 73I is provided between the valve stem 59 of the first intake valve $\mathbf{56}_1$ and the valve lifter $71_1$. The valve resting mechanism 73I can switch an acting state and a non-acting state of a pressing force applied from the valve lifter $71_1$ to the first intake valve $56_1$ in the valve opening direction. To be more specific, in a specific operational region, typically, a low speed operational region of the engine E, the valve resting mechanism 73I creates the non-acting state of the pressing force, thereby turning the first intake valve $56_1$ into the resting state irrespective of the sliding motion of the valve lifter $71_1$.

Figure 7:
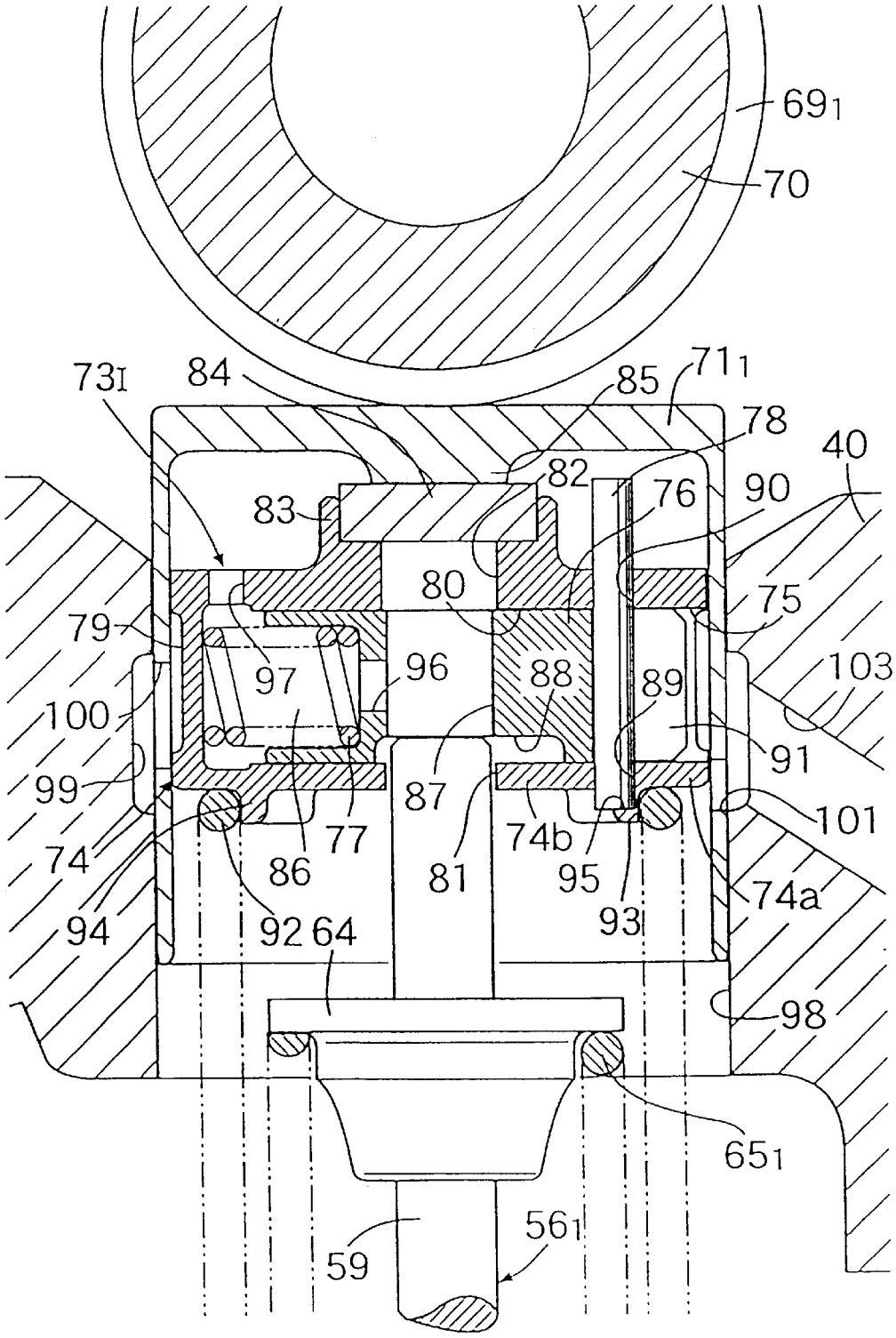
FIG. 7 is an enlarged vertical sectional view of a valve resting mechanism.

Referring to FIG. 7, the valve resting mechanism 73I includes a pin holder 74 slidably fitted in the valve lifter $71_1$; a slide pin 76 slidably fitted in the pin holder 74 so as to form a hydraulic chamber 75 between the inner surface of the valve lifter $71_1$ and the slide pin 76; a return spring 77, provided between the slide pin 76 and the pin holder 74, for biasing the slide pin 76 in the direction of reducing the volume of the hydraulic chamber 75; and a stopper pin 78 functioning as a rotation stopping means, provided between the pin holder 74 and the slide pin 76, for stopping the rotation of the slide pin 76 around its axis.

Figure 8:
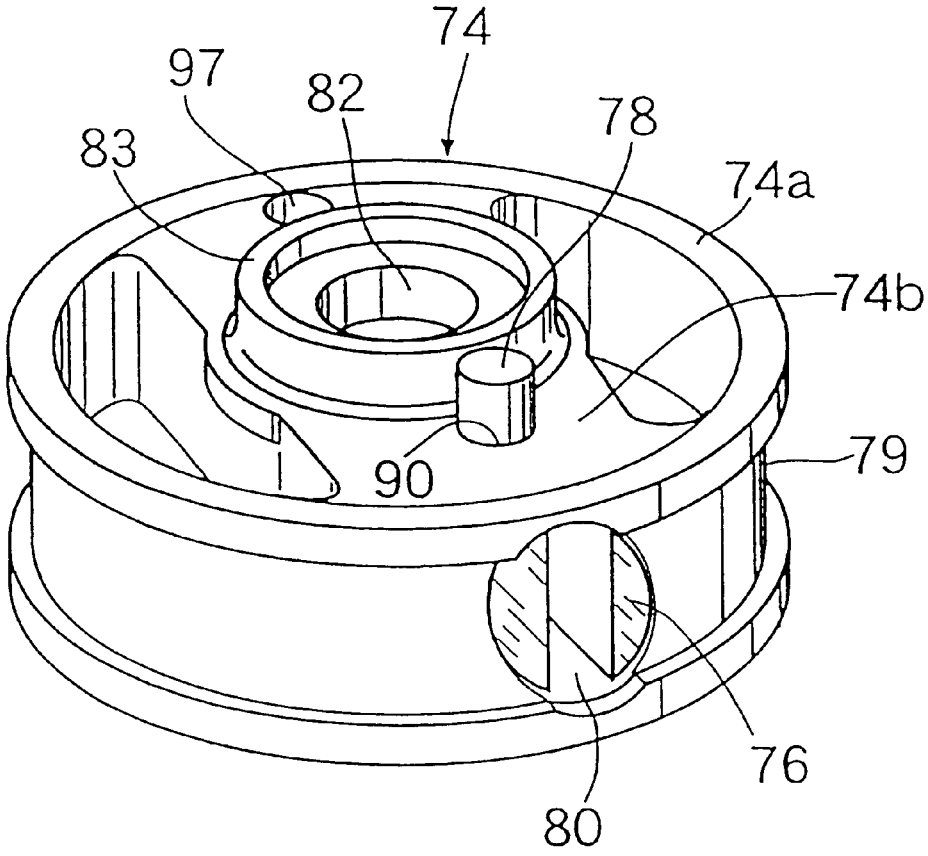
FIG. 8 is a perspective view, seen from above, of a pin holder.
Figure 9:
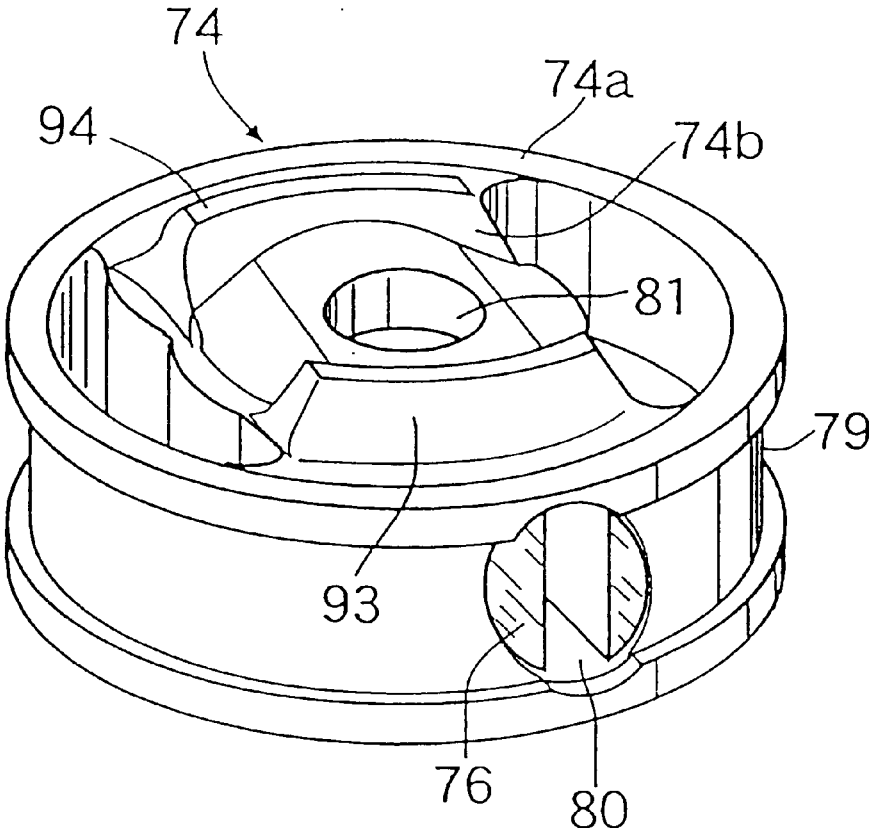
FIG. 9 is a perspective view, seen from below, of the pin holder.

Referring to FIGS. 8 and 9, the pin holder 74 includes a ring portion 74*a* slidably fitted in the valve lifter $71_1$; and a bridging portion 74*b*, integrated with the ring portion 74*a*, for connecting, the opposed inner peripheral portions of the ring portion 74*a* along one diameter line of the ring portion 74*a*. The inner periphery of the ring portion 74*a* and both the side surface portions of the bridging portion 74*b* are partially cut off to reduce the weight. The pin holder 74 is made from a steel or an aluminum alloy by lost-wax casting or forging, or made from a synthetic resin. The outer peripheral surface of the metal made pin holder 74, that is, the outer peripheral surface of the metal made ring portion 74*a* and the inner peripheral surface of the valve lifter $71_1$ are subjected to carburization.

An annular groove 79 is formed in the outer peripheral portion of the pin holder 74, that is, the outer peripheral portion of the ring portion 74*a*. A bottomed sliding hole 80 is provided in the bridging portion 74*b* of the pin holder 74. The sliding hole 80 has an axis along one diameter line of the ring portion 74*a*, that is, an axis perpendicular to the axis of the valve lifter $71_1$.

One end of the sliding hole 80 is opened to the annular groove 79 and the other end thereof is closed. An insertion hole 81 for allowing the leading end of the valve stem 59 of the first intake valve $56_1$ to pass therethrough is formed at the center of a lower portion of the bridging portion 74*b* so as to be opened to the sliding hole 80. An extension hole 82 for containing the leading end of the valve stem 59 of the first intake valve $56_1$ is provided at the center of an upper portion of the bridging portion 74*b* so as to be coaxial with the insertion hole 81 with the sliding hole 80 put between the insertion hole 81 and the extension hole 82.

A containing cylinder portion 83 coaxial with the axis of the extension hole 82 is integrally formed on a portion, facing to the closed end of the valve lifter $71_1$, of the bridging portion 74*b* of the pin holder 74. A disk-like shim 84 for blocking the end of the extension hole 82 on the closed side of the valve lifter $71_1$ is partially fitted in the containing cylinder portion 83. A projecting portion 85 to be in contact with the shim 84 is integrally formed at a central portion on the inner surface of the closed end of the valve lifter $71_1$.

The slide pin 76 is slidably fitted in the sliding hole 80 of the pin holder 74. If the pin holder 74 is made from a synthetic resin, only the slide-contact portion of the pin holder 74 with the slide pin 76 may be made from a metal.

The hydraulic chamber 75 communicated to the annular groove 79 is formed between one end of the slide pin 76 and the inner surface of the valve lifter $71_1$. The return spring 77 is contained in a spring chamber 86 formed between the other end of the slide pin 76 and the closed end of the sliding hole 80.

Figure 10:
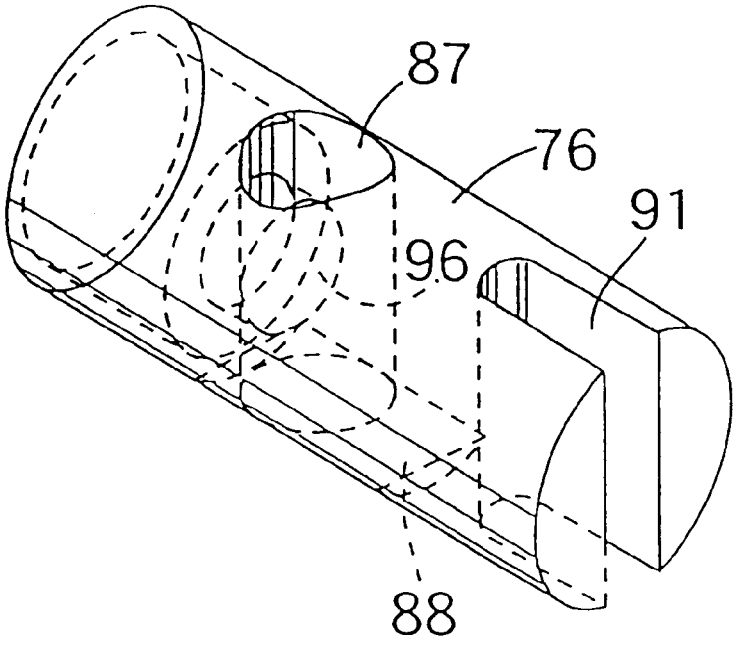
FIG. 10 is a perspective view of a slide pin.

Referring to FIG. 10, a containing hole 87, which can be coaxially communicated to the insertion hole 81 and the extension hole 82 and can also contain the leading end of the valve stem 59, is provided at the intermediate axial portion of the slide pin 76. The end of the containing hole 87 on the insertion hole 81 side is opened to a flat contact plane 88 formed on the outer surface of the lower portion of the slide pin 76 so as to face to the insertion hole 82. To be more specific, the contact plane 88 is relatively longer along the axis direction of the slide pin 76, and the containing hole 87 is opened in the contact plane 88 at a position offset to the spring chamber 86 side.

Such a slide pin 76 is slid in the axial direction so that a hydraulic pressure of the hydraulic chamber 75 acting to one end of the slide pin 76 is balanced against a spring force of the return spring 77 acting to the other end side of the slide pin 76. In the non-acting state in which the hydraulic pressure of the hydraulic chamber 75 is low, the slide pin 76 is moved rightward in FIG. 7 for containing the leading end of the valve stem 59 inserted in the insertion hole 81 in the containing hole 87 and the extension hole 82. In the acting state in which the hydraulic pressure of the hydraulic chamber 75 is high, the slide pin 76 is moved leftward in FIG. 7 for offsetting the containing hole 87 from the axes of the insertion hole 81 and the extension hole 82, thereby bringing the leading end of the valve stem 59 into contact with the contact plane 88.

When the slide pin 76 is moved to the position wherein the containing hole 87 is coaxial with the insertion hole 81 and the extension hole 82, the first intake valve $56_1$ remains at rest. To be more specific, at this time, the pin holder 74 and the slide pin 76 are moved on the first intake valve $56_1$ side along with the sliding motion of the valve lifter $71_1$ by the pressing force acting from the first intake side valve system cam $69_1$. However, only the leading end of the valve stem 59 is contained in the containing hole 87 and the extension hole 82, and the pressing force is not applied from the valve lifter $71_1$ and the pin holder 74 to the first intake valve $56_1$ in the valve opening direction.

When the slide pin 76 is moved to the position wherein the leading end of the valve stem 59 is in contact with the contact plane 88, the first intake valve $56_1$ is operated to be opened/closed. To be more specific, at this time, the pin holder 74 and the slide pin 76 are moved toward the first intake valve $56_1$ side along with the sliding motion of the valve lifter $71_1$ by the pressing force acting from the first intake side valve system cam $69_1$, so that the pressing force is applied to the first intake valve $56_1$ in the valve opening direction. In this way, the first intake valve $56_1$ is operated to be opened/closed in accordance with the rotation of the first intake side valve system cam $69_1$.

If the slide pin 76 is rotated around its axis in the pin holder 74, the axis of the containing hole 87 is offset from those of the insertion hole 81 and the extension hole 82 so that the leading end of the valve stem 59 cannot be brought into contact with the contact plane 88. To cope with such an inconvenience, the stopper pin 78 is provided for stopping the rotation of the slide pin 76 around its axis.

The stopper pin 78 is mounted in mounting holes 89 and 90 which are coaxially provided in the bridging portion 74*b* of the pin holder 74 so as to put part of the sliding hole 80 on its one end side therebetween. The stopper pin 78 passes through a slit 91 provided on the one end side of the slide pin 76 so as to be opened to the hydraulic chamber 75 side. To be more specific, the stopper pin 78 is mounted in the pin holder 74 in a state in which it passes through the slide pin 76 while permitting the axial movement of the slide pin 76. Accordingly, the stopper pin 78 is brought into contact with the inner closed end of the slit 91, so that the movement of the slide pin 76 toward the hydraulic chamber 75 side is restricted.

A coil spring 92 is provided for biasing the pin holder 74 on the side on which the shim 84 mounted on the pin holder 74 is in contact with the projecting portion 85 provided at the central portion on the inner surface of the closed end of the valve lifter $\mathbf{71}_1$. To be more specific, the coil spring 92 is disposed between the pin holder 74 and the cylinder head 40 so as to surround the valve stem 59 at a position where the outer periphery of the coil spring 92 is not brought into contact with the inner surface of the valve lifter $\mathbf{71}_1$. A pair of projections 93 and 94 are integrally provided on the bridging portion 74*b* of the pin holder 74. The projections 93 and 94 function as positioning portions for positioning the end of the coil spring 92 in the direction perpendicular to the axis of the valve stem 59.

Each of the projections 93 and 94 are formed into a circular-arc centered at the axis of the valve stem 59. They project from the pin holder 74 by an amount less than the diameter of the coil spring 92.

The projection 93 has a stepped portion 95 brought into contact with the end portion, on the first intake valve $\mathbf{56}_1$ side, of the stopper pin 78, thereby preventing the movement of the stopper pin 78 on the first intake valve $\mathbf{56}_1$ side.

To prevent a change in pressure in the spring chamber 86 by the axial movement of the slide pin 76, the slide pin 76 has a communication hole 96 through which the spring chamber 86 is communicated to the containing hole 87 Meanwhile, to prevent a change in pressure of a space between the pin holder 74 and the valve lifter $\mathbf{71}_1$ due to temperature change, the pin holder 74 has a communication hole 97 through which the space is communicated to the spring chamber 86.

The cylinder head 40 has a supporting hole 98 for slidably supporting the valve lifter $\mathbf{71}_1$, and an annular recess 99 is provided in the supporting hole 98 so as to surround the valve lifter $\mathbf{71}_1$. The valve lifter $\mathbf{71}_1$ has a communication hole 100 through which the annular recess 99 is communicated to the annular groove 79 formed in the pin holder 74 irrespective of the sliding motion of the valve lifter $\mathbf{71}_1$ in the supporting hole 98, and also has a release hole 101.

The release hole 101 is provided in the valve lifter $\mathbf{71}_1$ so as to allow, when the valve lifter $\mathbf{71}_1$ is moved at the uppermost position in FIG. 7, communication between the annular recess 99 to the inside of the valve lifter $\mathbf{71}_1$ through the lower portion of the release hole 101 positioned under the pin holder 74. The release hole blocks communication between the annular recess 88 and the inside of the valve lifter $\mathbf{71}_1$ as the valve lifter $\mathbf{71}_1$ is moved downwardly from the uppermost position in FIG. 7.

The cylinder head 40 also has working oil feed passages 103 communicated to the annular recesses 99 of the combustion chambers 43.

An exhaust side valve system 68E for driving the first and second exhaust valves $\mathbf{57}_1$ and $\mathbf{57}_2$ of the combustion chambers 43 includes a cam shaft 106, bottomed cylindrical valve lifters $\mathbf{107}_1$, and bottomed cylindrical valve lifters $\mathbf{107}_2$. The cam shaft 106 has first exhaust side valve system cams $\mathbf{105}_1$ corresponding to the first exhaust valves $\mathbf{57}_1$ and the second exhaust side valve system cams $\mathbf{105}_2$ corresponding to the second exhaust valves $\mathbf{57}_2$. The valve lifters $\mathbf{107}_1$ are supported by the cylinder head 40 so as to be slidably driven by the first exhaust side valve system cams $\mathbf{105}_1$.

The valve lifters $\mathbf{107}_2$ are supported by the cylinder head 40 so as to be slidably driven by the second exhaust side valve system cams $\mathbf{105}_2$.

The cam shaft 106 has an axis perpendicular to the extensions of the axes of the valve stems 61 of the first and second exhaust valves $\mathbf{57}_1$ and $\mathbf{57}_2$ and is rotatably supported between the cylinder head 40 and the holder 55 connected to the cylinder head 40 like the cam shaft 70 of the intake side valve system 68I. The valve lifters $\mathbf{107}_1$ are slidably fitted in the cylinder head 40 so as to be slidably movable in the same axial direction as the axes of the valve stems 61 of the first exhaust valves $\mathbf{57}_1$. The outer surface of the closed end of each valve lifter $\mathbf{107}_1$ is in slide-contact with the associated one of the first exhaust side valve system cams $\mathbf{105}_1$. The valve lifters $\mathbf{107}_2$ are slidably fitted in the cylinder head 40 so as to be slidably movable in the same axial direction as the axes of the valve stems 61 of the second exhaust valves $\mathbf{57}_2$. The outer surface of the closed end of each valve lifter $\mathbf{107}_2$ is in slidecontact with the associated one of the second exhaust side valve system cams $\mathbf{105}_2$.

The leading end of the valve stem 61 of the second exhaust valve $\mathbf{57}_2$ is in contact with the inner surface of the closed end of the valve lifter $\mathbf{107}_2$ via a shim 108. The second exhaust valve $\mathbf{57}_2$ is, during operation of the engine E, usually operated to be opened/closed by the second exhaust side valve system cam $\mathbf{105}_2$. A valve resting mechanism 73E is provided between the valve stem 61 of the first exhaust valve $\mathbf{57}_1$ and the valve lifter $\mathbf{107}_1$. The valve resting mechanism 73E can switch an acting state and a non-acting state of a pressing force applied from the valve lifter $\mathbf{107}_1$ to the first exhaust valve $\mathbf{57}_1$ in the valve opening direction. To be more specific, in a specific operational region, typically, a low speed operational region of the engine E, the valve resting mechanism 73E creates the non-acting state of the pressing force, thereby turning the first exhaust valve $\mathbf{57}_1$ into the resting state irrespective of the sliding motion of the valve lifter $\mathbf{107}_1$. The valve resting mechanism 73E has the same configuration as that of the valve resting mechanism 73I of the intake side valve system 68I.

Figure 11:
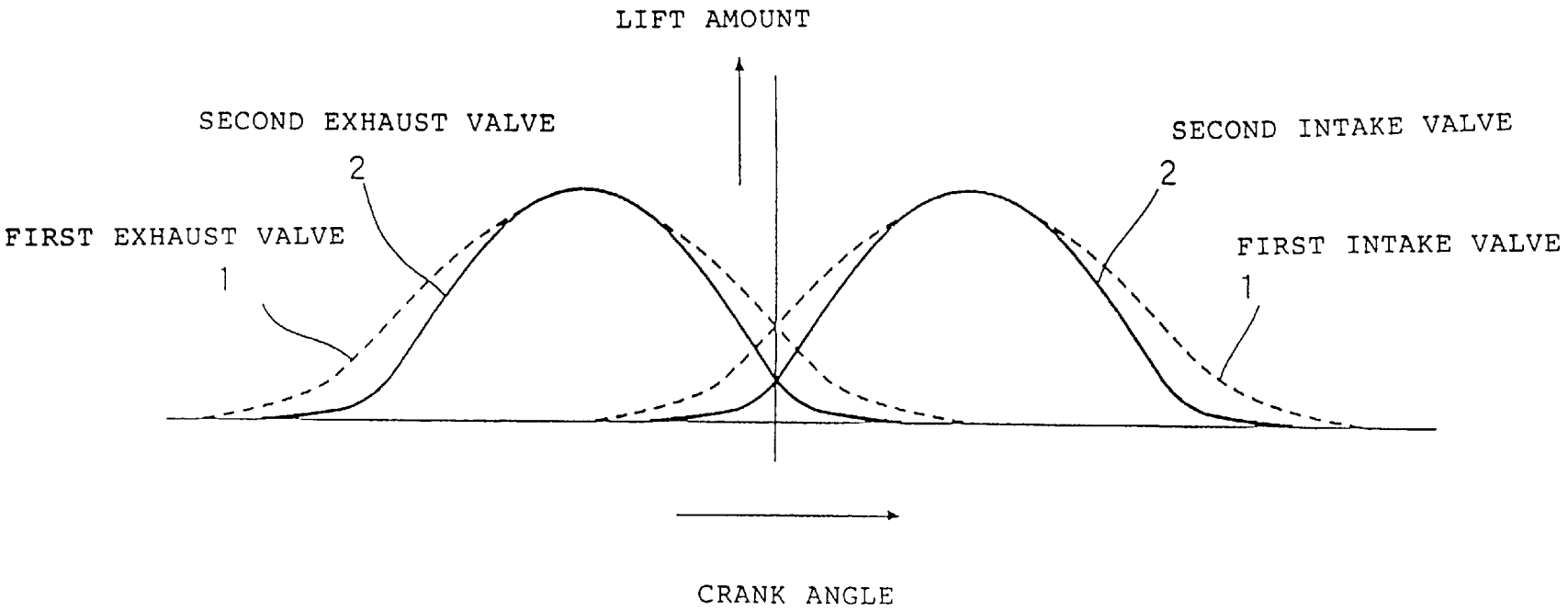
FIG. 11 is a plot of the valve opening lift amounts of intake valves and exhaust valves.

In the non-acting state of the valve resting mechanism 73I and 73E, that is, in the state in which the first intake valve $\mathbf{56}_1$ and the first exhaust valve $\mathbf{57}_1$ are operated to be opened/closed, as shown by broken curves in FIG. 11, the first intake side valve system cam $\mathbf{69}_1$ and the first exhaust side valve system cam $\mathbf{105}_1$ are operated so that the total opening angle is made relatively large and the angle wherein the opening state of the first intake valve $\mathbf{56}_1$ is overlapped to that of the first exhaust valve $\mathbf{57}_1$ is made relatively large. However, as shown by solid curves in FIG. 11, the second intake side valve system cam $\mathbf{69}_1$ and the second exhaust side valve system cam $\mathbf{105}_2$ are operated so that the total opening angle is made relatively small and the angle wherein the opening state of the second intake valve $\mathbf{56}_2$ is overlapped to that of the second exhaust valve $\mathbf{57}_2$ is made relatively small.

In accordance with such intake side and exhaust side valve systems 68I and 68E, in a low speed operational region as a specific operational region of the engine E, the first intake valve $\mathbf{56}_1$ and the first exhaust valve $\mathbf{57}_1$ are rested and only the second intake valve $56_2$ and the second exhaust valve $57_2$ are operated to be opened/closed. At this time, since the angle wherein the opening state of the second intake valve $56_2$ is overlapped to that of the second exhaust valve $57_2$ is relatively small, the rear compression ratio in the combustion chamber 43 can be improved, and since swirl occurs by flow-in of the fuel-air mixture in the combustion chamber 43 only through the second intake passage $46_2$, the fuel consumption can be reduced and the output torque is increased. In a high speed operational region, since the valve resting mechanisms 73I and 73E are turned into the acting state, not only the second intake valves $56_2$ and the second exhaust valves $57_2$ are usually operated to be opened/closed, but also the first intake valve $56_1$ and the first exhaust valve $57_1$ are operated to be opened/closed, with a result that the output in the high speed operational region can be enhanced. Accordingly, in a wide operational region from low speed to high speed operation, it is possible to enhance output and to reduce fuel consumption.

As described above, in a low speed operational region of the engine E, the first intake valve $56_1$ is rested, and in such a state, fuel remains in the intake passage corresponding to the intake valve $56_1$, that is, the first intake passage $46_1$. And, when the operation for the low speed operational region is switched to the operation for a high speed operational region in which the intake valves $56_1$ and $56_2$ are operated to be opened/closed, the fuel thus remaining in the first intake passage $46_1$ flows in the combustion chamber 43, and thereby the concentration of the fuel in the combustion chamber 43 becomes temporarily dense. This may reduce the output of the engine E and cause occurrence of unburned hydrocarbon.

A solution to this condition is shown in FIG. 6. A communication passage 109, which communicates the second intake passage $46_2$ corresponding to the second intake valve $56_2$ (usually opened/closed upon operation of the engine E to the first intake passage $46_1$, corresponding to the first intake valve $56_1$ rested in a specific operation region upon the operation of the engine E) is formed in the cylinder head 40. In the resting state of the first intake valve $56_1$, the fuel-air mixture in the first intake passage $46_1$ flows in the second intake passage $46_2$ through the communication passage 109 as shown by arrow 110 in FIG. 6.

The communication passage 109 is formed in the cylinder head 40 obtained by casting, by cutting from the combustion chamber 43 side, so as to be tilted toward the combustion chamber 43 in the direction from the second intake passage $46_2$ to the first intake passage $46_1$. The opening end of the communication passage 109 for communicating the first intake passage $46_1$ to the second intake passage $46_2$ is disposed at a position as close to the combustion chamber 43 as possible.

Referring to FIG. 5, a containing hole 112 is provided in the cylinder head 40 at a position between the adjacent two, on the central side along the arrangement direction, of the four cylinder bores 37. The cylinder head 40 is partitioned by the containing hole 112 into first and second head portions $40_1$ and $40_2$.

A means such as a chain drive means for driving the cam shafts 70 and 106 of the intake side and exhaust side valve systems 68I and 68E is contained in the containing hole 112.

Figure 12:
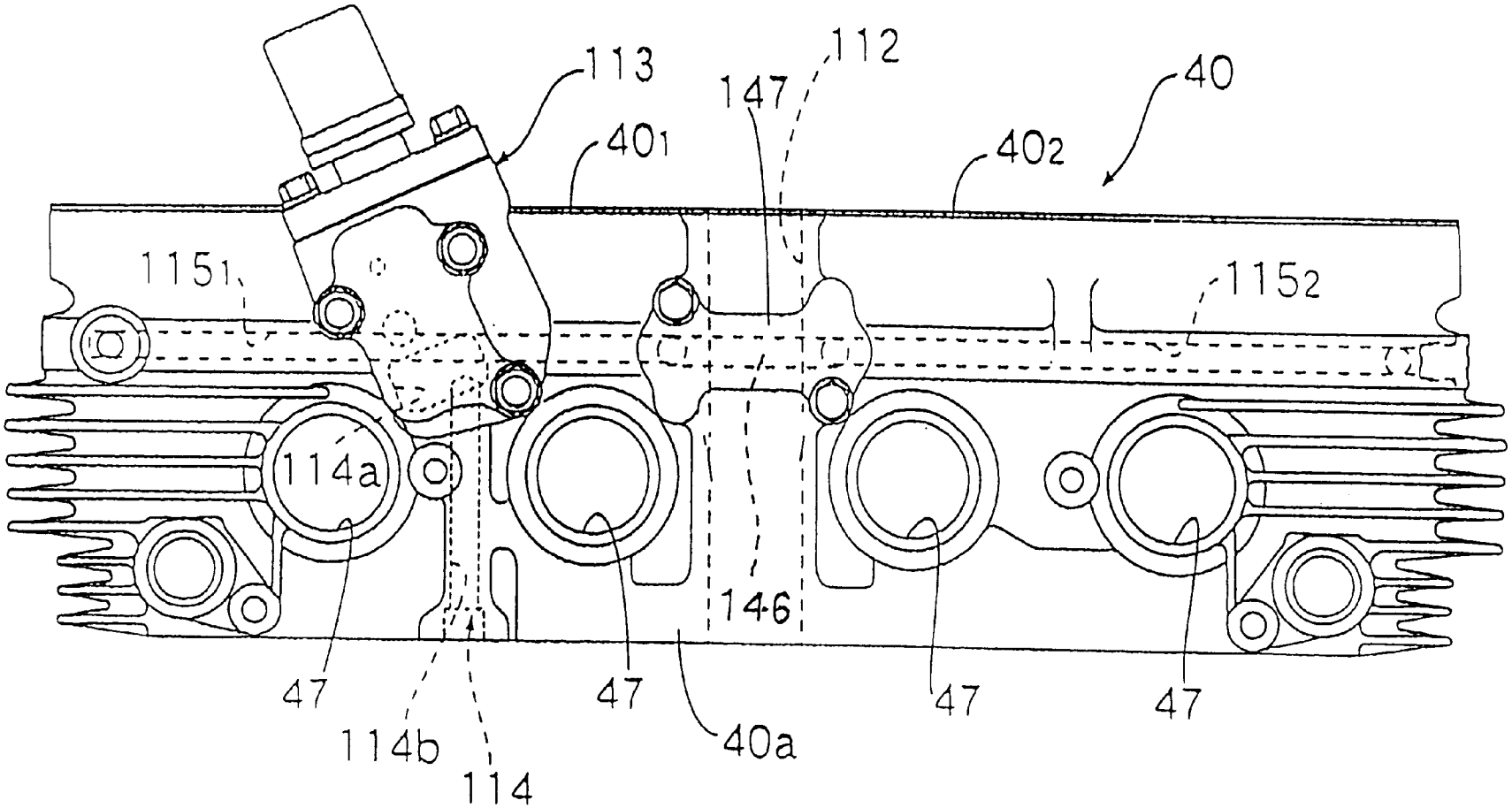
FIG. 12 is a side view, seen from an arrow 12 of FIG. 5, of the cylinder head.

Referring additionally to FIG. 12, a hydraulic control valve 113 is mounted on the one side surface 40*a* of the cylinder head 40 to which the intake ports 47 are opened at a position between a pair of the intake ports 47 disposed on the first head $40_1$ side. The hydraulic control valve 113 is used for controlling a hydraulic pressure of working oil fed to the valve resting mechanism 43I and 43E of the intake side and exhaust side valve systems 68I and 68E.

Figure 13:
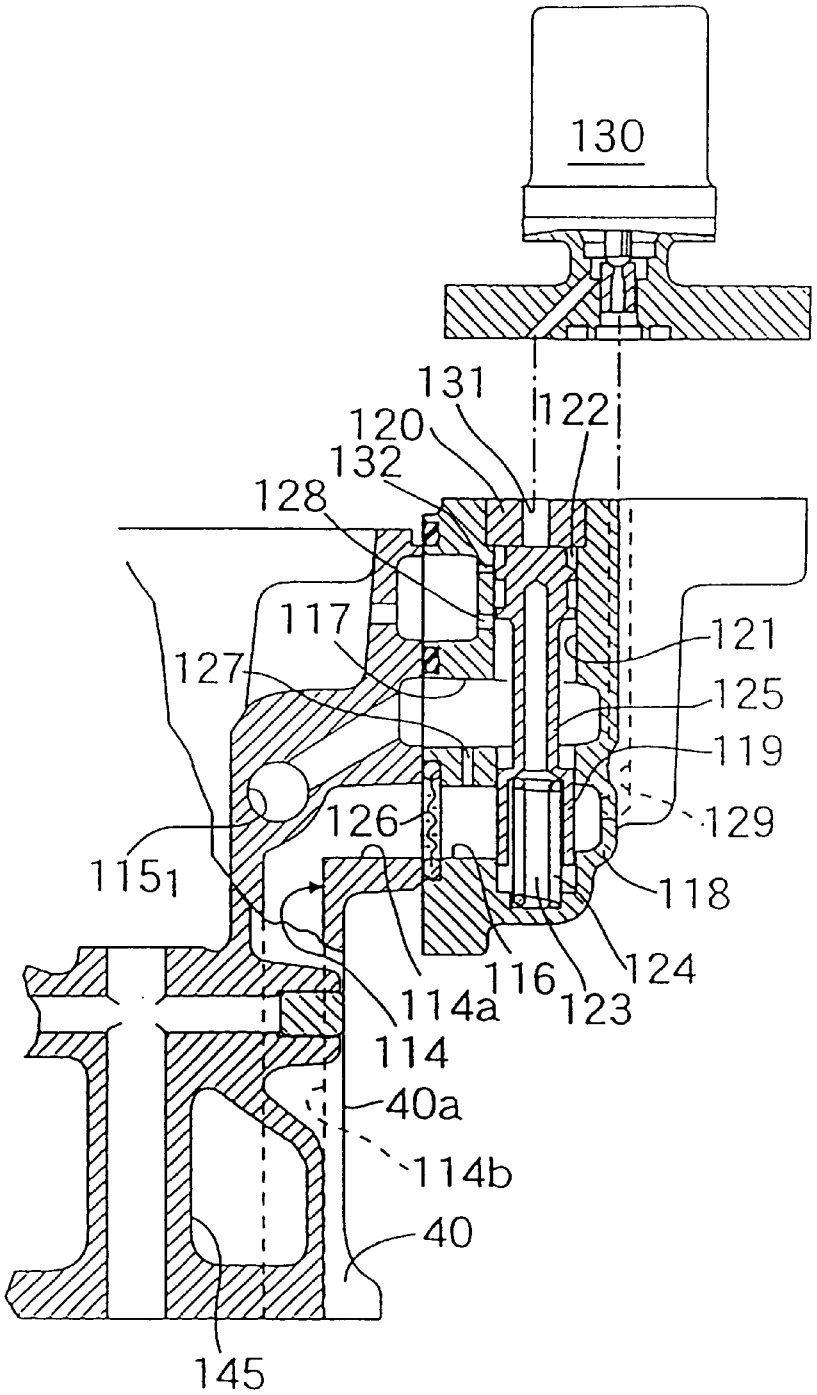
FIG. 13 is a sectional view showing a configuration of a hydraulic control valve.

Referring to FIG. 13, the hydraulic control valve 113 is mounted on the one side surface 40*a* of the cylinder head 40 for switching the on/off of the communication between the opening end of a working oil intake passage 114 to the one side surface 40*a* of the cylinder head 40 and the opening end of a first working oil discharge passage $115_1$ to the one side surface 40*a* of the cylinder head 40. The hydraulic control valve 113 includes an inlet 116 communicated to the working oil intake passage 114, an outlet 117 communicated to the first working oil discharge passage $115_1$, and a spool valve body 119 slidably fitted in a housing 118 mounted on the side surface 40*a* of the cylinder head 40.

The housing 118 has a cylinder hole 121 with its upper end blocked by a cap 120. The spool valve body 119 is slidably fitted in the cylinder hole 121 so as to form a hydraulic chamber 122 between the cap 120 and the spool valve body 119. A spring chamber 123 is formed between the lower portion of the housing 118 and the spool valve body 119. A spring 124 biases the spool valve body 119 upwardly, that is, in the closing direction is contained in the spring chamber 123. The spool valve body 119 has an annular recess 125 for allowing communication between the inlet 116 and the outlet 117. When the spool valve body 119 is moved upwardly as shown in FIG. 13, it blocks the communication between the inlet 116 and the outlet 117.

In a state in which the housing 118 is mounted on the one side surface 40*a* of the cylinder head 40, an oil filter 126 is held between the inlet 116 and the working oil intake passage 114. The housing 118 also has an orifice hole 127 for communicating the inlet 116 to the outlet 117. Accordingly, even in a state in which the spool valve body 119 is located at the closing position, the inlet 116 is communicated to the outlet 117 through the orifice hole 127, so that a hydraulic pressure restricted by the orifice hole 127 is fed from the outlet 117 into the first working oil discharge passage 115.

The housing 118 also has a bypass port 128 communicated to the outlet 117 through the annular recess 125 only in the state in which the spool valve body 119 is located at the closing position. The bypass port 128 is communicated to the upper inside portion of the cylinder head 40.

The housing 118 also has a passage 129 usually communicated to the inlet 116. The passage 129 is connected via a solenoid valve 130 to a connection hole 131 formed in the cap 120 so as to be communicated to the hydraulic chamber 122. When the solenoid valve 130 is opened, a hydraulic pressure is fed into the hydraulic chamber 122, and the spool valve body 119 is driven to be opened by the hydraulic pressure thus introduced into the hydraulic chamber 122.

The housing 118 also has a leak jet 132 communicated to the hydraulic chamber 122. The leak jet 132 is also communicated to the upper inside portion of the cylinder head 40. When the solenoid valve 130 is closed, the hydraulic pressure remaining in the hydraulic chamber 122 is released through the leak jet 132.

Figure 14:
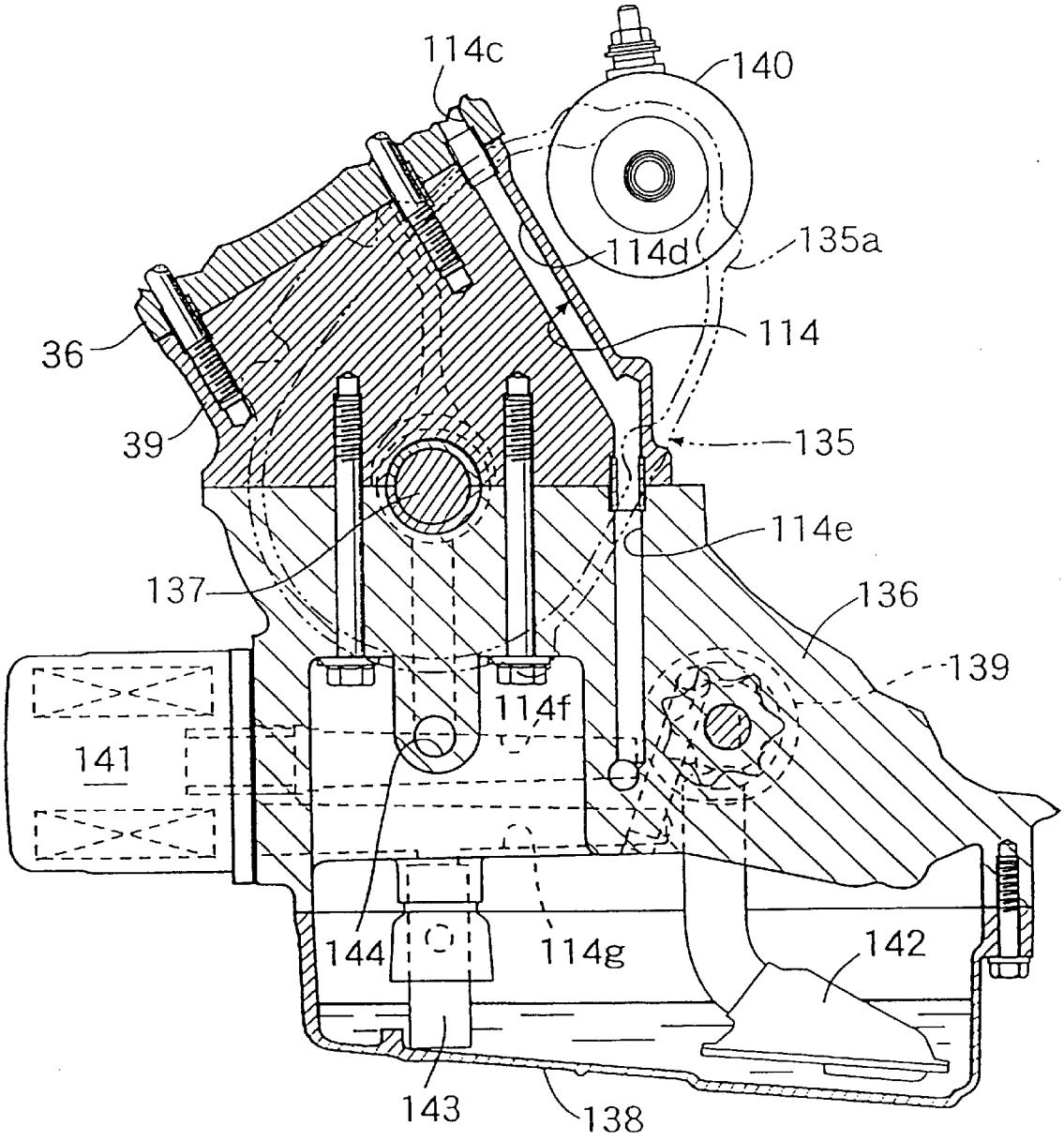
FIG. 14 is a vertical sectional view showing a hydraulic passage of the cylinder block and a crank case.

Referring to FIG. 14, a lower crank case 136 constituting part of a mission case 135 is connected to a lower portion of the upper crank case 39. A crank shaft 137 is rotatably supported between both the crank cases 39 and 136.

An oil pan 138 is connected to a lower portion of the lower crank case 136. An oil pump 139 for pumping up working oil remaining in the oil pan 138 is contained in the mission case 135. A projecting portion 135*a*, which projects upwardly from the upper crank case 39, is provided on the mission case 135. A starter motor 140 having a rotational axis parallel to the crank shaft 137 is mounted on the projecting portion 135*a* at a position over the upper crank case 39.

The working oil intake passage 114 for introducing working oil from the oil pump 135 to the hydraulic control valve 113 is provided in the cylinder head 40, the cylinder block 36, the upper crank case 39, and the lower crank case 136.

The working oil intake passage 114 includes a connection port 114*a* connected to the inlet 116 of the hydraulic control valve 113 and opened to the one side surface 40*a* of the cylinder head 40. A first passage 114*b* is provided in the cylinder head 40 so as to be connected to the connection port 114*a* and to extend in straight line along the one side surface 40*a*. A second passage 114*c* is provided in the cylinder block 36 so as to be coaxially connected to the first passage 114*b*. A third passage 114*d* is provided in the lower crank case 39 so as to be coaxially connected to the second passage 114*c* and to extend in straight line. A fourth passage 114*e* is provided in the lower crank case 136 so as to be connected to the lower end of the third passage 114*d* and to extend in the vertical direction. A fifth passage 114*f* is provided in the lower crank case 136 so as to be connected to the lower end of the fourth passage 114*e* and to extend substantially in the horizontal direction. a sixth passage 114*g* is provided in the lower crank case 136 so as to extend substantially in parallel to the fifth passage 114*f*. A filter 141 interposed between the fifth and sixth passages 114*f* and 114*g* is mounted in the lower crank case 136, and the sixth passage 114*g* is connected to a discharge port of the oil pump 139.

A strainer 142 disposed in the oil pan 138 is connected to an intake port of the oil pump 139. Working oil sucked in the oil pump 139 via the strainer 142 is discharged in the working oil intake passage 141 in which the filter 141 is interposed. A relief valve 143 for preventing excess of the hydraulic pressure of the working oil is connected between the oil pump 139 and the filter 141. An oil gallery 144 for feeding oil to each portion of the engine E to be lubricated is communicated to an intermediate portion of the fifth passage 114*f* connected to the filter 141.

A water jacket 145 is provided in the cylinder block 36 and the cylinder head 40. The first passage 114*b* and the second passage 114*c*, corresponding to the cylinder block 36 and the cylinder head 40, of the working oil intake passage 114 are disposed outside the water jacket 145.

Referring to FIGS. 5 and 12, the first head portion $\mathbf{40}_1$ of the cylinder head 40 has a first working oil discharge passage 115, for feeding working oil to the valve resting mechanisms 73I and 73E for each of the combustion chambers 43 disposed on the first head portion $\mathbf{40}_1$ side, and the second head portion $\mathbf{40}_2$ has a second working oil discharge passage $\mathbf{115}_2$ for feeding working oil to the valve resting mechanisms 73I and 73E for each of the combustion chambers 43 on the second head portion $\mathbf{40}_2$ side. The working oil feed passages 103 provided in the cylinder head 40 for the valve resting mechanisms 73I and 73E (see FIG. 7) are branched from the first and second working oil discharge passages $\mathbf{115}_1$ and $\mathbf{115}_2$.

A mounting seat 146 is mounted on the one side surface 40*a* of the cylinder head 40 so as to cross between the first and second head portions $\mathbf{40}_1$ and $\mathbf{40}_2$. The first and second working oil discharge passages $\mathbf{115}_1$ and $\mathbf{115}_2$ are provided in the cylinder head 40 so that one ends thereof are commonly opened to the mounting seat 146 and the other ends thereof are closed at a position near the containing hole 112.

A cover 147 is fastened to the mounting seat $\mathbf{146}_1$ and the working oil discharge passage $\mathbf{115}_1$ and $\mathbf{115}_2$ are communicated to each other via the cover 147.

The function of the first embodiment will not be described.

The communication passage 109 for communicating the second intake passage $\mathbf{46}_2$ (corresponding to the second intake valve $\mathbf{56}_2$ opened/closed even in a specific operational region to the first intake passage $\mathbf{46}_1$ corresponding to the first intake valve $\mathbf{56}_1$ rested in the specific operational region) is provided in the cylinder head 40. Accordingly, when the first intake valve $\mathbf{56}_1$ is rested, a fuel-air mixture flows from the first intake passage $\mathbf{46}_1$ corresponding to the rested first intake valve $\mathbf{56}_1$, to the second intake passage $\mathbf{46}_2$ corresponding to the opened/closed second intake valve $\mathbf{56}_2$ via the communication passage 109, so that it is possible to prevent the fuel from remaining in the first intake passage $\mathbf{46}_1$ in the resting state of the first intake valve $\mathbf{56}_1$. As a result, when the operation for the above specific operational region is switched to the operation for an operational region in which the intake valves $\mathbf{56}_1$ and $\mathbf{56}_2$ are both opened/closed, it is possible to eliminate the inconvenience that the remaining fuel flows in the combustion chamber 43. This makes it possible to prevent the mixing ratio of the fuel-air mixture flows in the combustion chamber 43 from being made unstable, and hence to prevent the reduction in engine output and the occurrence of unburned hydrocarbon as much as possible.

Since the phenomenon in which the fuel remains in the first intake passage $\mathbf{46}_1$ in the resting state of the first intake valve $\mathbf{56}_1$ can be prevented as described above, even if the intake system 51 is simply configured to have the carburetor 50 common to the intake passages $\mathbf{46}_1$ and $\mathbf{46}_2$, it is possible to avoid the inconvenience that the mixing ratio of the fuel-air mixture flowing in the combustion chamber 43 is made unstable when the operation for the specific operational region in which the first intake valve $\mathbf{56}_1$ is rested is switched to the operation for the operational region in which the intake valves $\mathbf{56}_1$ and $\mathbf{56}_2$ are both opened/closed.

The communication passage 109 can be simply formed in the cylinder head 40, having been obtained by casting, by cutting from the combustion chamber 43 side. Since the communication passage 109 is tilted toward the combustion chamber 43 in the direction from the second intake passage $\mathbf{46}_2$ to the first intake passage $\mathbf{46}_1$, the opening end of the communication passage 109 for communicating the first intake passage $\mathbf{46}_1$ rested in a specific operational region to the second intake passage $\mathbf{46}_2$ can be disposed at a position being as close to the combustion chamber 43 as possible. As a result, when the first intake valve $\mathbf{56}_1$ is rested in the specific operational region, the first intake passage $\mathbf{46}_1$, corresponding to the rested first intake valve $\mathbf{56}_1$ can be communicated to the second intake passage $\mathbf{46}_2$ at a position being as close to the combustion chamber 43 as possible, so that the remaining amount of fuel in the resting state of the first intake valve $\mathbf{56}_1$ can be made as small as possible.

The hydraulic control valve 113 for controlling the hydraulic pressure of working oil to the hydraulic valve resting mechanism 73I and 73E for resting the first intake valve $\mathbf{56}_1$ and the first exhaust valve $\mathbf{57}_1$ in a specific operational region are mounted on the side surface 40*a* of the cylinder head 40 to which a plurality of the intake ports 47 provided in the cylinder head 40 are opened. To be more specific, the hydraulic control valve 113 is mounted on the side surface 40*a* of the cylinder head 40 in the direction perpendicular to the arrangement direction of the cylinder bores 37, that is, in the forward or rearward direction (in the rearward direction in this embodiment) of the body frame 21. As a result, it is possible to avoid an excessive length of engine E along the direction of the cylinder bores 37, due to the mounting of the hydraulic control valve 113 to the cylinder head 40. That is to say, in the motorcycle in which the engine E is mounted on the body frame 21 with the arrangement of the cylinder bores 37 set in the width direction of the body frame 21, the length of the multi-cylinder engine E extending along the width direction of the body frame 21 can be reduced.

Since the hydraulic control valve 113 is mounted on the side surface 40*a* of the cylinder head 40 at a position between the adjacent two of the intake ports 47 by making effective use of a space therebetween, it is possible to make shorter the length of the multi-cylinder engine E along the width direction of the body frame 21.

Since the working oil intake passage 114 for introducing working oil from the oil pump 139 to the hydraulic control valve 113 is provided in the cylinder head 40, the cylinder block 36, and the crank cases 39 and 136, it is possible to eliminate the necessity of additional pipe line for introducing the working oil from the oil pump 139 to the hydraulic control valve 113, which simplifies the appearance of the multi-cylinder engine E.

Since the water jacket 145 is provided in the cylinder block 36 and the cylinder head 40 and the two parts, corresponding to the cylinder block 36 and the cylinder head 40, of the working oil intake passage 114 are disposed outside the water jacket 145, it is possible to effectively cool the working oil flowing in the working oil intake passage 114.

The working oil intake passage 114 has at least the first passage 114*b* provided in the cylinder head 40 so as to extend in straight line along the side surface 40*a* between the one side surface 40*a* of the cylinder head 40 and the water jacket 145. The second passage 114*c* is provided in the cylinder block 36 so as to be coaxial with the first passage 114*b*. The third passage 114*d* is provided in the upper crank case 39 so as to be coaxial with the second passage 114*c* and extend in straight line therefrom. As a result, it is possible to make the working oil passage from the oil pump 139 to the hydraulic control valve 113 as short as possible, and hence to reduce the loss in hydraulic pressure in the working oil intake passage 114.

The containing hole 112, which contains the means for driving the cam shafts 70 and 106, is provided in the cylinder head 40 at a position between the adjacent two, on the central side along the arrangement direction, of the four cylinder bores 37. The cylinder head 40 is partitioned by the containing hole 112 into the first and second head portions 40, and 402. As a result, it is possible to desirably keep the balance between the cylinder heads 40 along the arrangement direction of the cylinder bores 37, and thereby the balance of the multi-cylinder engine E as a whole.

The first working oil discharge passage $\mathbf{115}_1$ for supplying working oil to the valve resting mechanism 73I and 73E for each of the combustion chambers 43 on the first head portion $\mathbf{40}_1$ side is provided in the first head portion $\mathbf{40}_1$ so as to be connected to the hydraulic control valve 113 mounted on the side surface 40*a* of the cylinder head 40 between a pair of the intake ports 47 disposed on the first head portion $\mathbf{40}_1$ side.

The second working oil discharge passage $\mathbf{115}_2$ for supplying working oil to the valve resting mechanism 73I and 73E for each of the combustion chambers 43 on the second head portion $\mathbf{40}_2$ side is provided in the second head portion $\mathbf{40}_2$. The one-ends of the first and second working oil discharge passages $\mathbf{115}_1$ and $\mathbf{115}_2$ are opened to the mounting seat 146 formed on the side surface 40*a* of the cylinder head 40 so as to cross between the first and second head portions $\mathbf{40}_1$ and $\mathbf{40}_2$. The first and second working oil discharge passages $\mathbf{115}_1$ and $\mathbf{115}_2$ are communicated to each other via the cover 147 fastened to the mounting seat 146. Accordingly, the first and second working oil discharge passages $\mathbf{115}_1$ and $\mathbf{115}_2$ provided in the cylinder head 40 on both the sides of the containing hole 112 can be simply communicated to each other, and thereby working oil discharged from the single hydraulic control valve 113 can be effectively supplied to the valve resting mechanism 73I and 73E for each of the combustion chambers 43.

In the valve resting mechanism 73I (or 73E), the pin holder 74 is slidably fitted in the valve lifter $\mathbf{71}_1$ (or $\mathbf{107}_1$) driven by the valve system cam $\mathbf{59}_1$ (or $\mathbf{105}_1$).

The slide pin 76 slidably fitted in the pin holder 74 is slidable between the position wherein the leading end of the valve stem 59 (or 61) is contained in the containing hole 87 and the position wherein the leading end of the valve stem 59 (or 61) is in contact with the contact plane 88 as the outer side surface of the slide pin 76 in accordance with the balance between the hydraulic force and the spring force applied to both the ends of the slide pin 76. As a result, by controlling the hydraulic force applied to one end of the slide pin 76, it is possible to switch the resting state and the opening/closing state of the first intake valve $\mathbf{56}_1$ (or the first exhaust valve $\mathbf{57}_1$) from each other.

Since the rotation of the slide pin 76 around its axis in the pin holder 74 is prevented only by the simple configuration in which the stopper pin 78 is mounted in the pin holder 74, the valve resting mechanism 73I (or 73E) can be easily assembled with the stem 59 (or 61) of the first intake valve $\mathbf{56}_1$ (or the first exhaust valve $\mathbf{57}_1$) by mounting the valve lifter $\mathbf{71}_1$ (or $\mathbf{107}_1$) to the cylinder head 40 in the state that the pin holder 74 in which the slide pin 76 has been fitted is fitted in the valve lifter $\mathbf{71}_1$ (or $\mathbf{107}_1$).

The pin holder 74 has the insertion hole 81 into which the leading end of the stem 59 (or 61) of the first intake valve $\mathbf{56}_1$ (or the first exhaust valve $\mathbf{57}_1$) can be inserted, and also has the extension hole 82, disposed coaxially with the insertion hole 81, for containing the leading end of the valve stem 59 (or 61). The sliding hole 80 in which the slide pin 76 is slidably fitted is put between the insertion hole 81 and the extension hole 82. Accordingly, since in the resting state of the first intake valve $\mathbf{56}_1$ (or the first exhaust valve $\mathbf{57}_1$), the leading end of the valve stem 59 (or 61) is contained not only in the containing hole 87 but also in the extension hole 82, the length of the containing hole 87, that is, the diameter of the slide pin 76 can be made small. This makes it possible to miniaturize the pin holder 74 and hence to the miniaturize the entire valve resting mechanism 73I (or 73E).

The shim 84 for blocking the end portion of the extension hole 82 on the closed end side of the valve lifter $\mathbf{71}_1$ (or $\mathbf{107}_1$) is mounted on the pin holder 74 so that it can be brought into contact with the closed end of the valve lifter $\mathbf{71}_1$ ($\mathbf{107}_1$). To be more specific, it is required to block the end portion of the extension hole on the closed end side of the valve lifter for applying a pressing force from the valve lifter $\mathbf{71}_1$ (or $\mathbf{107}_1$) to the pin holder 74, and in this embodiment, the end portion of the extension hole 82 is blocked with the shim 84 brought into contact with the closed end of the valve lifter $\mathbf{71}_1$ (or $\mathbf{107}_1$). Accordingly, it is possible to simplify the structure of the pin holder 74, and to suitably adjust a gap at the valve head of the first intake valve $\mathbf{56}_1$ (or first exhaust valve $\mathbf{57}_1$) by changing the thickness of the shim 84.

The containing cylinder portion 83 coaxial with the axis of the extension hole 82 is integrally formed on the pin holder 74 at a position facing to the closed end of the valve lifter $\mathbf{71}_1$ (or $\mathbf{107}_1$), and the disk-like shim 84 is partially fitted in the containing cylinder portion 83. As a result, it is possible to simply mount the relatively small shim 84 on the pin holder 74.

The projecting portion 85 to be in contact with the shim 84 is integrally formed on the inner surface of the closed end of the valve lifter $\mathbf{71}_1$ (or $\mathbf{107}_1$), and accordingly, the sliding motion of the valve lifter $\mathbf{71}_1$ (or $\mathbf{107}_1$) with respect to the cylinder head 40 can be reliably performed along the axis of the valve stem 59 (or 61) so that the pressing force is applied from the valve lifter $\mathbf{71}_1$ (or $\mathbf{107}_1$) to the pin holder 74 on the extension of the axis of the valve stem 59 (or 61) of the first intake valve $\mathbf{56}_1$ (or the first exhaust valve $\mathbf{57}_1$). As a result, the sliding motion of the valve lifter $\mathbf{71}_1$ (or $\mathbf{107}_1$) can be smoothened.

The coil spring 92 for biasing the pin holder 74 toward the closed end side of the valve lifter $\mathbf{71}_1$ (or $\mathbf{107}_1$) is provided between the pin holder 74 and the cylinder head 40. To be more specific, the coil spring 92 is disposed so as to surround the valve stem 59 (or 61) at a position wherein the outer periphery of the coil spring 92 is not in contact with the inner surface of the valve lifter $\mathbf{71}_1$ (or $\mathbf{107}_1$). The projections 93 and 94 for positioning the end portion of the coil spring 92 in the direction perpendicular to the axis of the valve stem 59 (or 61) are provided on the pin holder 74. As a result, it is possible to allow the spring force of the coil spring 92 to be reliably applied along the axis of the valve stem 59 (or 61), and to prevent the occurrence of frictional loss due to slide-contact of the outer periphery of the coil spring 92 with the valve lifter $\mathbf{71}_1$ (or $\mathbf{107}_1$).

Since the projecting amount of each of the projections 93 and 94 is less than the diameter of the coil spring 92, even if the coil spring 92 is contracted, it is not in slide-contact with the pin holder 74. As a result, it is possible to prevent the occurrence of the frictional loss due to the slide-contact of the coil spring 92 with the pin holder 74.

Figure 15:
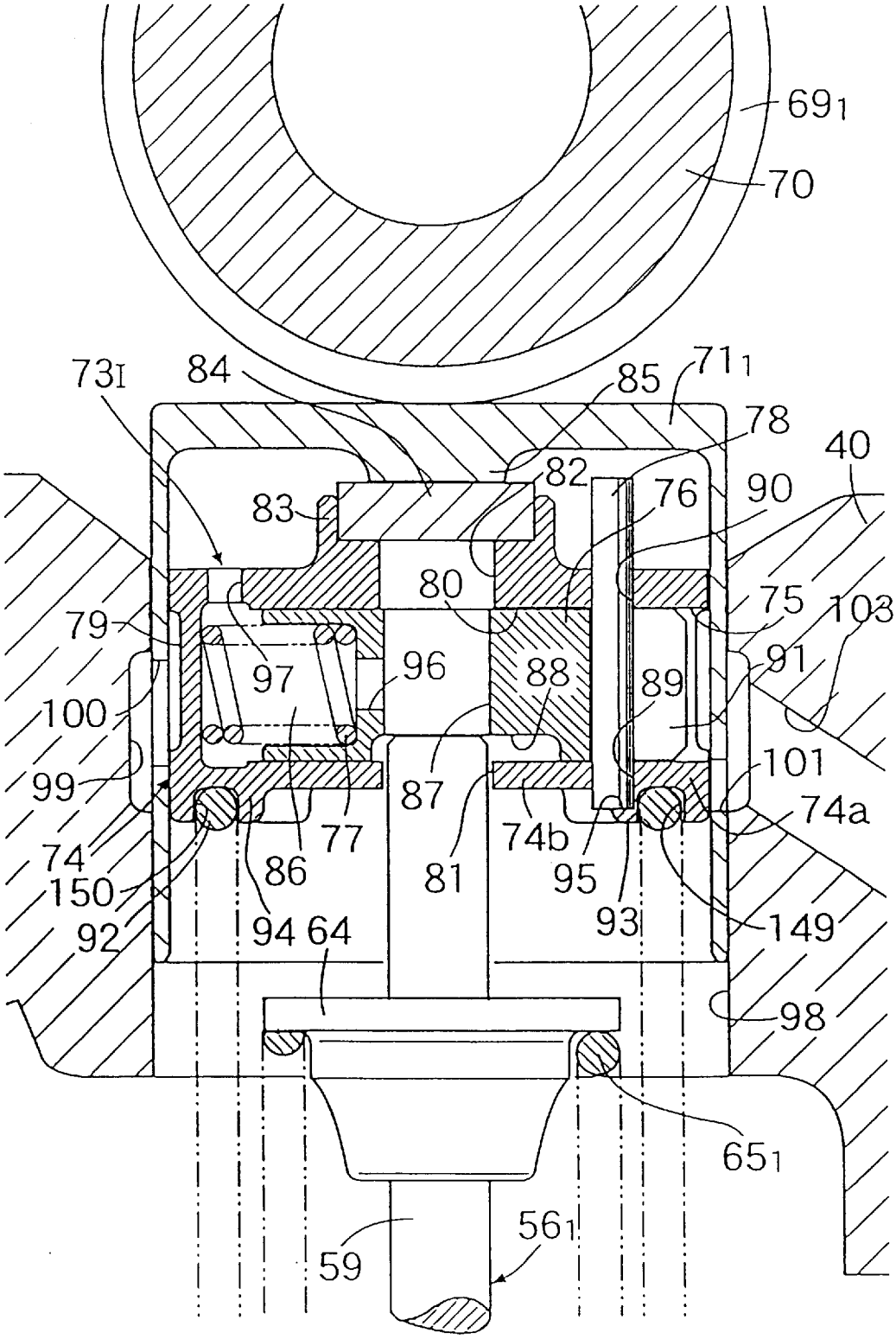
FIG. 15 is a sectional view, similar to FIG. 7, showing a second embodiment of the present invention.

A second embodiment of the present invention will be described with reference to FIG. 15. The coil spring 92 provided between the pin holder 74 and the cylinder head 40 is disposed so as to surround the valve stem 59 at a position wherein the outer periphery of the coil spring 92 is not in slide-contact with the inner surface of the valve lifter $\mathbf{71}_1$. At this time, grooves 149 and 150 for positioning the end portion of the coil spring 92 in the direction perpendicular to the axis of the valve stem 59 may be provided in the pin holder 74. The depth of each of the grooves 149 and 150 is set to be less than the diameter of the coil spring 92.

Even in this second embodiment, as in the first embodiment, it is possible to allow the spring force of the coil spring 92 to be reliably applied along the axis of the valve stem 59, and to prevent the occurrence of frictional loss due to slide-contact of the outer periphery of the coil spring 92 with the valve lifter $\mathbf{71}_1$. Further, even if the coil spring 92 is contracted, the coil spring 92 is not in slide-contact with the pin holder 74. As a result, it is possible to prevent the occurrence of the frictional loss due to slide-contact of the coil spring 92 with the pin holder 74.

As described above, according to the present invention, since the rotation of the slide pin around its axis in the pin holder is prevented by the rotation stopping means, the valve resting mechanism can be easily assembled to the valve stem by mounting the valve lifter to the cylinder head in a state that the pin holder in which the slide pin has been fitted is fitted in the valve lifter.

In addition, the rotation stopping means can be simplified.

It is further possible to reduce the size of the containing hole, that is, the diameter of the slide pin, and hence to miniaturize the pin holder and further miniaturize the valve resting mechanism as a whole. Further, it is possible to simplify the structure of the pin holder, and to suitably adjust a gap at the valve head of the engine valve by changing the thickness of the shim.

It is further possible to simply mount a relatively small shim on the pin holder.

It is also possible to more surely perform the sliding motion of the valve lifter with respect to the cylinder head along the axis of the valve stem, and hence to smoothen the sliding motion of the valve lifter.

The spring force of the coil spring along the axis of the valve stem can be reliably applied, and frictional loss due to the slide-contact of the outer periphery of the coil spring with the valve lifter can be reduced. Even if the coil spring is contracted, it is not in slide-contact with the pin holder. As a result, it is possible to prevent the occurrence of the frictional loss due to the slide-contact of the coil spring with the pin holder.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve system for an engine comprising:

an intake valve and an exhaust valve, said intake and exhaust valve having a valve body capable of closing one of an intake and an exhaust port, the intake and exhaust ports being provided in a cylinder head and opening to a combustion chamber;

valve stems, one stem being connected to each valve body;

a valve lifter supported in and axially slidable within said cylinder head; and a valve resting mechanism disposed between the valve stem associated with the valve and the valve lifter; wherein the valve resting mechanism enables an acting state and a non-acting state of a pressing force applied from the valve lifter to the valve in the valve opening direction, the valve resting mechanism including:

a pin holder slidably fitted in said valve lifter, the pin holder having an essentially cylindrical shape with an end abutting the valve lifter opposite to a point wherein the valve lifter abuts a valve system cam, and an axis of the pin holder substantially parallel to an axis of the valve lifter, wherein a sliding hole is formed in the pin holder and has an axis substantially perpendicular to the axis of the pin holder, and an insertion hole opens into an inner surface of the sliding hole so as to allow the valve stem associated with the exhaust valve to be slidably inserted therethrough, the pin holder further including:

an extension hole capable of containing the leading end of said valve stem associated with the exhaust valve, said extension hole being coaxial with said insertion hole, and said sliding hole being disposed between said insertion hole and said extension hole; and a shim for blocking an end portion of said extension hole on a closed end side of said valve lifter, the shim being mounted on said pin holder so as be engageable with the closed end of the valve lifter;

a slide pin slidably disposed in the valve lifter and having one end facing to a hydraulic chamber, the slide pin having a containing hole coaxially connected to said insertion hole, wherein the slide pin is fitted in said sliding hole and slidable between a position wherein said containing hole is coaxially aligned to said insertion hole, for allowing a leading end of said valve stem associated with the exhaust valve to be contained in said containing hole, wherein the leading end of said valve stem associated with the exhaust valve is brought into contact with an outer side surface of said slide pin;

a return spring for biasing the slide pin in the direction of reducing the volume of the hydraulic chamber;

a rotation stopping member, the rotation stopping member being mounted in a bridging portion of the pin holder and being capable of stopping rotation of said slide pin about its axis, wherein said rotation stopping member is a stopper pin mounted in said pin holder so as to pass through said slide pin while permitting movement of said slide pin; and a containing cylinder portion is coaxial with the axis of said extension hole and is provided on said pin holder at a position facing to the closed end of said valve lifter, wherein said shim has a disk shape and is partially fitted in said containing cylinder portion.

2. The valve system of claim 1, wherein a projecting portion is provided on the inner surface of the closed end of said valve lifter and is engageable with said shim.

3. The valve system of claim 2, wherein:

a coil spring for biasing said pin holder toward the closed end of said valve lifter is provided between said pin holder and said cylinder head so as to surround said valve stem at a position wherein the outer periphery of said coil spring is not in contact with an inner surface of said valve lifter; and positioning portions for positioning an end portion of said coil spring in a direction substantially perpendicular to the axis of said valve stem associated with the exhaust valve are provided on said pin holder.

4. The valve system of claim 3, wherein said positioning portions are projections integrally formed with said pin holder, a projecting amount of each of said projections being less than a diameter of said coil spring.

5. The valve system of claim 3, wherein said positioning portions are grooves provided in said pin holder, the depth of each of said grooves being less than the diameter of said coil spring.

* * * * *